US007320663B2

(12) United States Patent
Toda

(10) Patent No.: US 7,320,663 B2
(45) Date of Patent: Jan. 22, 2008

(54) CONTINUOUS MEDIUM FOLDING DEVICE AND CONTINUOUS MEDIUM PRINTING APPARATUS HAVING THEREOF

(75) Inventor: Yasunori Toda, Kawasaki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/987,901

(22) Filed: Nov. 16, 2001

(65) Prior Publication Data

US 2003/0036469 A1 Feb. 20, 2003

(30) Foreign Application Priority Data

Aug. 20, 2001 (JP) ..... 2001-249119

(51) Int. Cl.
*B31F 1/08* (2006.01)

(52) U.S. Cl. ..... 493/414; 493/413; 493/12; 493/27

(58) Field of Classification Search ..... 493/413, 493/414, 23, 27, 12, 417; 28/101
See application file for complete search history.

(56) References Cited

U.S. PATENT DOCUMENTS 3,083,437 A * 4/1963 Davis, Jr. ..... 53/504
3,917,250 A * 11/1975 Branick ..... 270/30.04
4,097,039 A * 6/1978 Fischer ..... 493/29
4,474,567 A * 10/1984 Mugrauer et al. ..... 493/410
4,505,466 A * 3/1985 Buss ..... 270/30.03
4,597,752 A * 7/1986 Muller et al. ..... 493/410
4,618,340 A * 10/1986 Meschi ..... 493/13
4,716,706 A * 1/1988 Boeckmann ..... 53/117
4,723,488 A * 2/1988 Inouye et al. ..... 101/143
4,730,762 A * 3/1988 Felix ..... 225/4
4,828,540 A * 5/1989 Fordyce ..... 493/414
4,846,454 A * 7/1989 Parkander ..... 270/5.02
5,062,597 A * 11/1991 Martin et al. ..... 270/39.02
5,074,837 A * 12/1991 Blanton et al. ..... 493/412
5,219,321 A * 6/1993 Schwebbach ..... 493/414
5,558,318 A * 9/1996 Crowley et al. ..... 270/39.05
5,616,113 A * 4/1997 Van Den Bergh ..... 493/23
5,701,717 A * 12/1997 Gutknecht ..... 53/117
6,071,223 A * 6/2000 Reider et al. ..... 493/410

(Continued)

FOREIGN PATENT DOCUMENTS

JP 5-49761 6/1993

(Continued)

OTHER PUBLICATIONS

Office Action from the Japanese Patent Office dated Jun. 30, 2006 in corresponding Japanese Patent Application No. 2001-249119.

*Primary Examiner*—Christopher Harmon
(74) *Attorney, Agent, or Firm*—Westerman, Hattori, Daniels & Adrian, LLP.

(57) ABSTRACT

The present invention relates to a device for folding continuous medium including a swing arm pivotable about an axis at one end of the swing arm. The continuous medium is guided by the swing arm and accordion-folded with equal widths as a result of the swinging operation of the swing arm. The swing arm has a telescopic structure for varying the length of the swing arm over a range of a swing of the swing arm.

8 Claims, 27 Drawing Sheets

U.S. PATENT DOCUMENTS 6,511,408 B2 * 1/2003 Miki et al. ..... 493/413

FOREIGN PATENT DOCUMENTS

JP 5-201595 8/1993
JP 6-87360 12/1994
JP 07-041244 2/1995
JP 08-081124 3/1996
JP 9-121588 5/1997

* cited by examiner

SWING ARM 91

HOME POSITION DETECTING MECHANISM 104

SUB-ARM 110

HOME POSITION DETECTING MECHANISM 125

CONTINUOUS MEDIUM FOLDING DEVICE AND CONTINUOUS MEDIUM PRINTING APPARATUS HAVING THEREOF

BACKGROUND OF THE INVENTION

1. Field of the Invention

The present invention relates to a continuous medium folding device, and particularly relates to a continuous medium folding device for folding a printed continuous medium along transversal perforations using a swing arm such that the continuous medium is accordion-folded.

2. Description of the Related Art

Among various types of printers such as an electrophotographic printer, a continuous medium printing device is known as a printer which can print marks on a continuous medium.

The continuous medium printing device includes a hopper where the continuous medium is stored and a stacker in which the continuous medium is received. The continuous medium printing device pulls out the continuous medium from a stacker, prints marks on the continuous medium and accommodates the printed continuous medium in the stacker. The above-described continuous medium folding device is provided at the stacker. The swing arm swings right and left such that the printed continuous medium is accordion-folded along transversal perforations.

Recently, there is a need for a higher throughput for a printing operation. In order to meet such a need, it is required to increase a transportation speed of the continuous medium. Thus, it is required to operate the swing arm at an increased swinging rate.

On the other hand, the continuous medium to be printed may be provided in various thicknesses depending on the use. For example, it may be required to send the continuous medium separated at transverse perforations using a postal service. In such a case, in order to reduce the weight of the postal matter, the continuous medium must have reduced thickness. However, it is known that the stiffness of the continuous medium reduces as the thickness of the continuous medium is reduced. Thus, since the continuous medium with reduced thickness easily bends during the folding operation, a high reliability folding cannot be guaranteed. This is particularly the case where the processing speed of the device is increased.

Accordingly, there is a need for a continuous medium folding device which can securely fold continuous medium of reduced thickness while the swing arm is operated at a high swinging rate.

FIG. 1 is a schematic diagram showing a continuous medium folding device 10 of the related art. The continuous device 10 includes a continuous medium swaying mechanism 30 provided at a central position above a stacker table 20 and continuous medium fold-line pressing mechanisms 40 and 50 provided at an X2_side and X1-side, respectively, above the stacker table 20.

The continuous medium swaying mechanism 30 includes a hollow swing arm 31 through which a continuous medium 1 is guided and a swing mechanism (not shown) for swinging the swing arm 31 in A1- and A2-directions.

The continuous medium fold-line pressing mechanism 40 includes a flap 41 and a mechanism (not shown) for pivoting the flap 41 in B1- and B2-directions in a reciprocating manner. The continuous medium fold-line pressing mechanism 50 includes a flap 51 and a mechanism (not shown) for pivoting the flap 51 in B1- and B2-directions in a reciprocating manner.

The swing arm 31 swings in the A1- and A2-directions about an axis 32 at a rate corresponding to a feeding speed of the continuous medium 1 fed in a direction shown by an arrow Z2. The swing arm 31 uses its tip part 31*a* to support and direct the continuous medium 1 towards the table 20 and sway the continuous medium 1 alternately in the X1- and X2- directions. In this manner, the continuous medium 1 is folded at a constant width. The flaps 41 and 51 are pivoted alternately in synchronous with the swinging rate of the swing arm 31, so as to press the fold lines 12 and 13 of the continuous medium 1.

Accordingly, the continuous medium 1 is folded along the transverse perforations 4 into an accordion-like configuration and is received on the stacker table 20. Reference 5 represents an accordion-folded continuous medium which is received on the stacker table 20.

When the swing arm 31 swings in A1-A2 directions and the continuous medium 1 is swayed, a higher pressure is produced on the front side of the continuous medium 1 and a lower pressure is produced on the back side. The terms "front" and "back" are defined in the direction of sway of the continuous medium 1. The difference in the front-side pressure and the back-side pressure causes a bending force of the continuous medium 1.

When the continuous medium 1 of thin sheets is used, the stiffness of sheet is small. Therefore, the above-described bending force becomes greater than the stiffness of the sheets. Thus, the continuous medium 1 will be bent as shown by reference 15 and will not be folded normally. This may cause an unacceptably bad folding.

A trajectory 300 of a tip part 31*a* of the swing arm 31 becomes an arc of a circle centered on the axis 32. Therefore, particularly, when the swing arm 31 is swayed through to the right and left end positions, the tip part 31*a* leaves the top surface 6 of the stacked continuous medium 5 and the length of the continuous medium 1 protruding from the tip part 31*a* of the swing arm 31 becomes greatest. Therefore, the bend 15 of the continuous medium 1 may occur when the swing arm 31 is swayed and reaches near the right or left end positions.

In order to prevent the occurrence of the bend 15 of the continuous medium, it is desirable to minimize the distance between the tip of the swing arm 31 and the top surface 6 of the stacked continuous medium 5.

SUMMARY OF THE INVENTION

Accordingly, it is a general object of the present invention to provide a continuous medium folding device which can solve the problems described above.

It is another and more specific object of the present invention to provide a continuous medium folding device which can prevent bending of the continuous medium even in case of a continuous medium having a reduced thickness.

In order to achieve the above objects, a device for folding continuous medium is provided, which includes a swing arm pivotable about an axis at one end of the swing arm, the continuous medium being guided by said swing arm and accordion-folded with equal widths as a result of the swinging operation of the swing arm. The swing arm has a telescopic structure for varying the length of the swing arm over a range of a swing of the swing arm.

With the continuous medium folding device described above, the distance between the tip of the swing arm and the tip surface of the continuous medium is kept short. Therefore, the continuous medium can be reliably guided to the table where it is folded along the fold lines. In other words, the length of the part of the continuous medium supported by the swing arm is increased and thus the wind pressure exerted on the continuous medium is also reduced. Accordingly, the continuous medium can be properly folded without causing any bend even in a case where a thin continuous medium is used.

Further, the present invention provides a continuous medium printing apparatus provided with the continuous medium folding device described above.

DETAILED DESCRIPTION OF THE PREFERRED EMBODIMENTS

Figure 1:
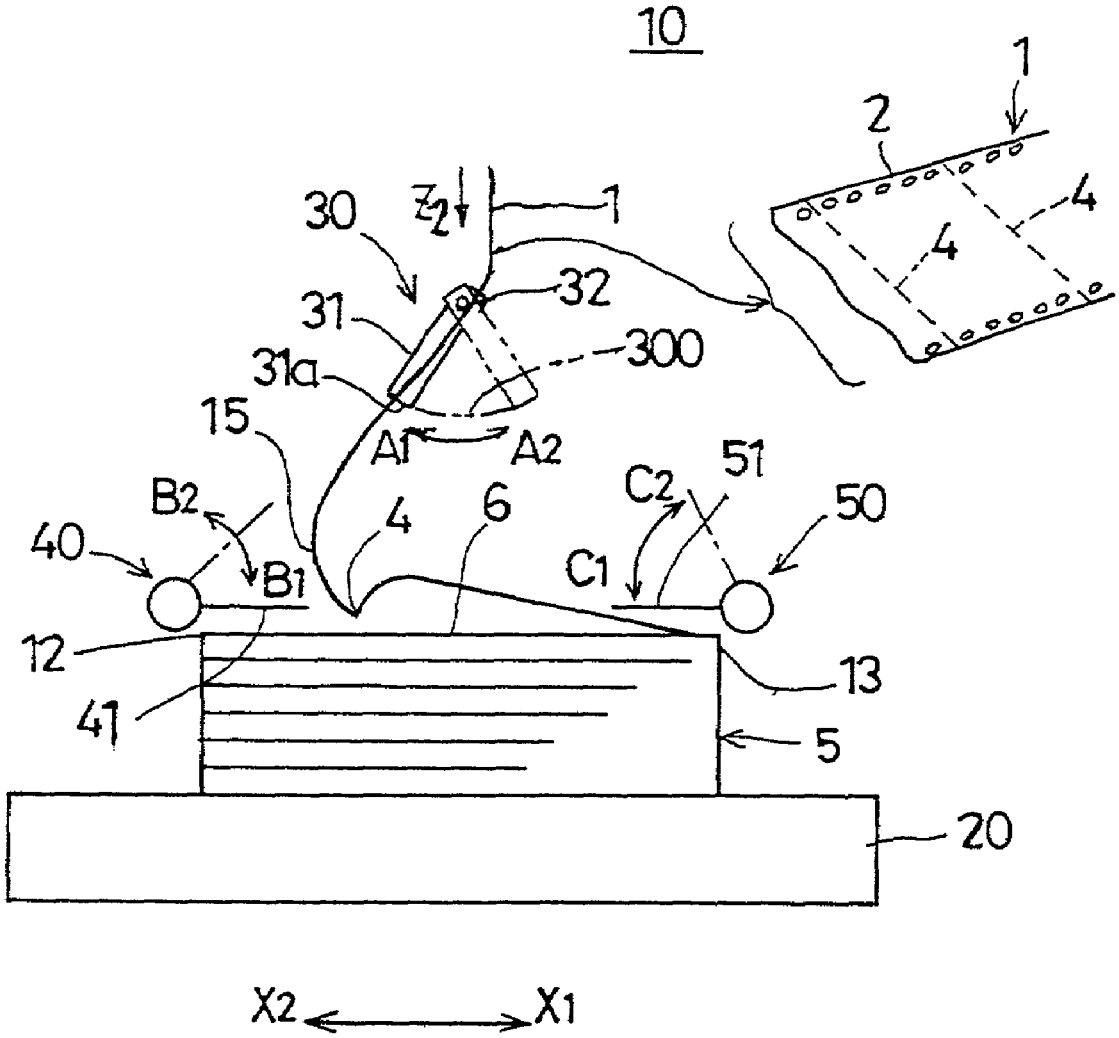
FIG. 1 PRIOR ART
FIG. 1 is a diagram showing a continuous medium folding device of the related art.

In the following, principles and embodiments of the present invention will be described with reference to the accompanying drawings.

Firstly, for the sake of convenience of an explanation, an electrophotographic printer 60 adopting a continuous medium folding device of the present invention will be described with reference to FIGS. 1 and 2. In the figures, a double headed arrow X1-X2 shows a direction of the width, Y1-Y2 shows a direction of the depth, and Z1-Z2 shows a direction of the height. The Y2 side is the front side of the electrophotographic printer 60 and the Y2 side is the back side of the electrophotographic printer 60.

The electrophotographic printer 60 includes a hopper unit 62, a tractor unit 64, a printing unit 65 and a stacker unit 67. The hopper unit 62 receives a continuous medium box 61 for accommodating a continuous medium 1 folded in an accordion-manner. The continuous medium 1 may be made of a sheet-like material such as paper. The tractor unit 64 pulls out the continuous medium 1 from the continuous medium box 61 which serves as a continuous medium accommodating part and feeds it in the direction of an arrow 63. The printing unit 65 prints marks on the continuous medium 1 fed from the tractor unit 64. The printed continuous medium is fed in the direction of an arrow 66. The stacker unit 67 accommodates the printed continuous medium which is folded in an accordion-manner.

The printing unit 65 includes a photosensitive drum 70 rotating in a clock-wise direction, an optics part 71 provided on a peripheral part of the photo-sensitive drum 70 and a fixing unit 72 for fixing an image transferred onto the continuous medium 1 onto the continuous medium 1. Around the photo-sensitive drum 70, a pre-charging part 73, the optics part 71 for forming a latent image corresponding to record information onto the photosensitive drum 70, a developing part 74 for developing the latent image, a transfer part 75 for transferring the image on the photo-sensitive drum 70 onto the continuous medium 1, a cleaning part 76 and an electric charge removing part 77.

Figure 4:
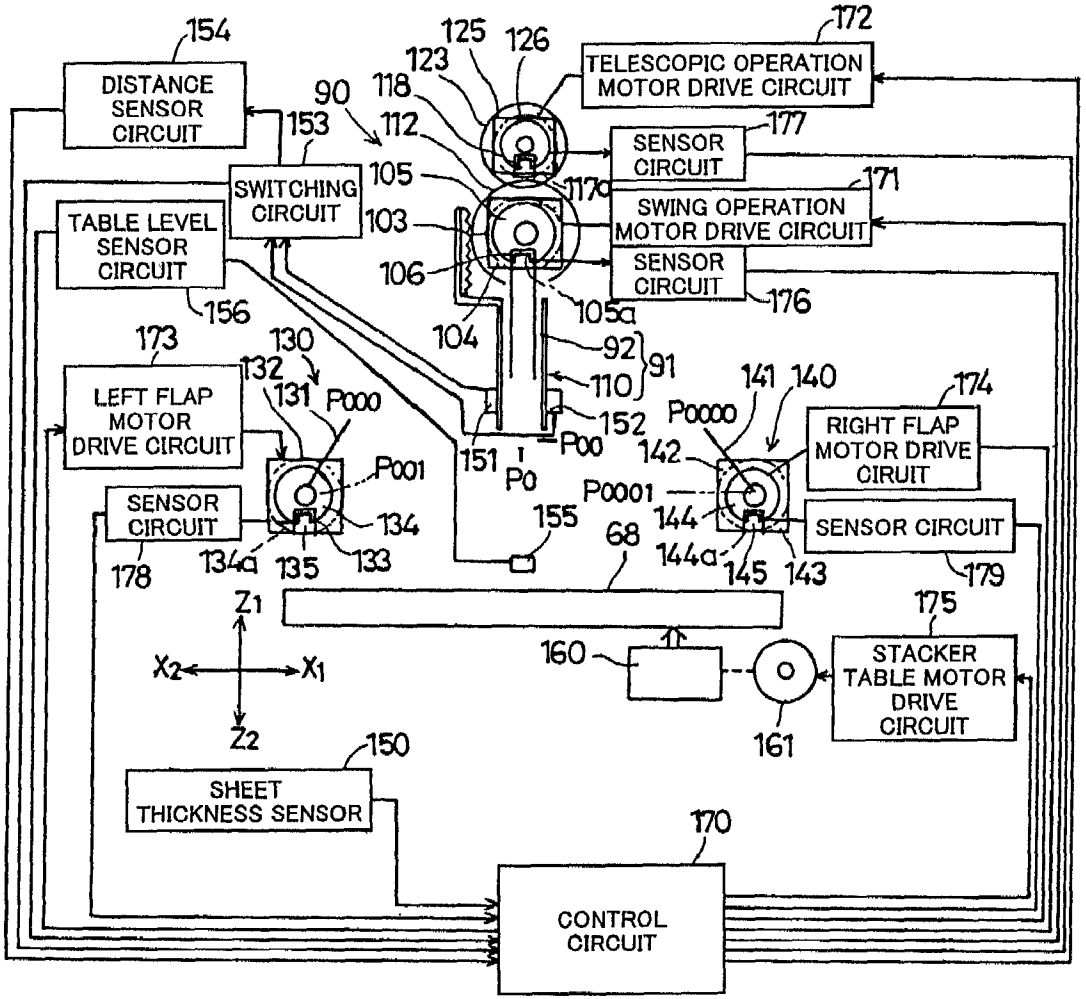
FIG. 4 is a schematic diagram showing a continuous medium folding device of an embodiment of the present invention.

The stacker unit 67 is provided with a continuous medium folding device 80 shown in FIG. 4. The continuous medium folding device 80 includes a continuous medium swaying mechanism 90 provided above the central part of the stacker table 68 and continuous medium fold-line pressing mechanisms 130, 140. The continuous medium swaying mechanism 90 sways the continuous medium in the direction of the width of the folds. The continuous medium fold-line pressing mechanisms 130, 140 temporarily press parts of the folded transverse perforations 12, 13.

Firstly, the continuous medium swaying mechanism 90 will be described.

The swing arm of the related art rotationally swings about an axis. Therefore, when the swing arm of the related art swings in the direction of the width of the folds of the continuous medium, the distance between the tip of the swing arm and the top surface of the continuous medium of the table becomes greater at extreme positions of the swing range. If the length between the axis and the tip of the swing arm is extended, the tip of the swing arm comes closer to the top surface of the continuous medium on the table. Therefore, the distance between the tip of the swing arm and the top surface of the continuous medium of the table becomes smaller. In order to fold the continuous medium 1 in a stable manner, it is preferred to keep this distance smaller. Accordingly, the continuous medium swaying mechanism 90 is configured such that the distance between the tip of the swing arm and the top surface of the continuous medium mounted on the table remains small.

As shown in FIGS. 5A, 5B, 6 and 7, the continuous medium swaying mechanism 90 is configured such that its length varies as it swings right and left (i.e., in the X1-X2 direction) and includes elements such as a swing arm 91, a swing-operation motor 103 and an telescopic operation motor 123.

The swing arm 91 has a telescopic structure including elements such as an arm main body 92 and a sub-arm 110. With such a telescopic structure, the length of the swing arm can be varied over a range of a swing of the swing arm.

The arm main body 92 includes shaft members 93 and 94 aligned along the Y1-Y2 direction with a separation between them and two rectangular plate members 95 and 96 fixed to the shaft members 93 and 94 such that the shaft members 93 and 94 are interposed between the plate members 95 and 96. The shaft members 93 and 94 are supported by side-surface plates 97 and 98 of the stacker unit 67 at bearings 99 and 100, respectively. Thus, the shaft members 93 and 94 are movable in the A1-A2 direction in an oscillating manner. Between the plate members 95 and 96, The arm main body 92 is provided with a passage 101 through which the continuous medium 1 is fed.

The swing operation motor 103 which is a pulse motor is fixed on a bracket 102 fixed on the side-surface plate 97. The swing operation motor 103 is directly coupled to the shaft member 93 via a coupling 104. The swing operation motor 103 is provided with a swing arm home position detecting mechanism 104 for detecting home position P0 of the swing arm 91.

Home position P0 of the swing arm 91 is a position where the swing arm 91 extends towards the Z2-direction.

The swing arm home position detecting mechanism 104 includes a notched disk 105 fixed to the shaft of the motor 103 and a photo-coupler 106 for detecting a notch 105*a* of the disk 105.

Figure 7:
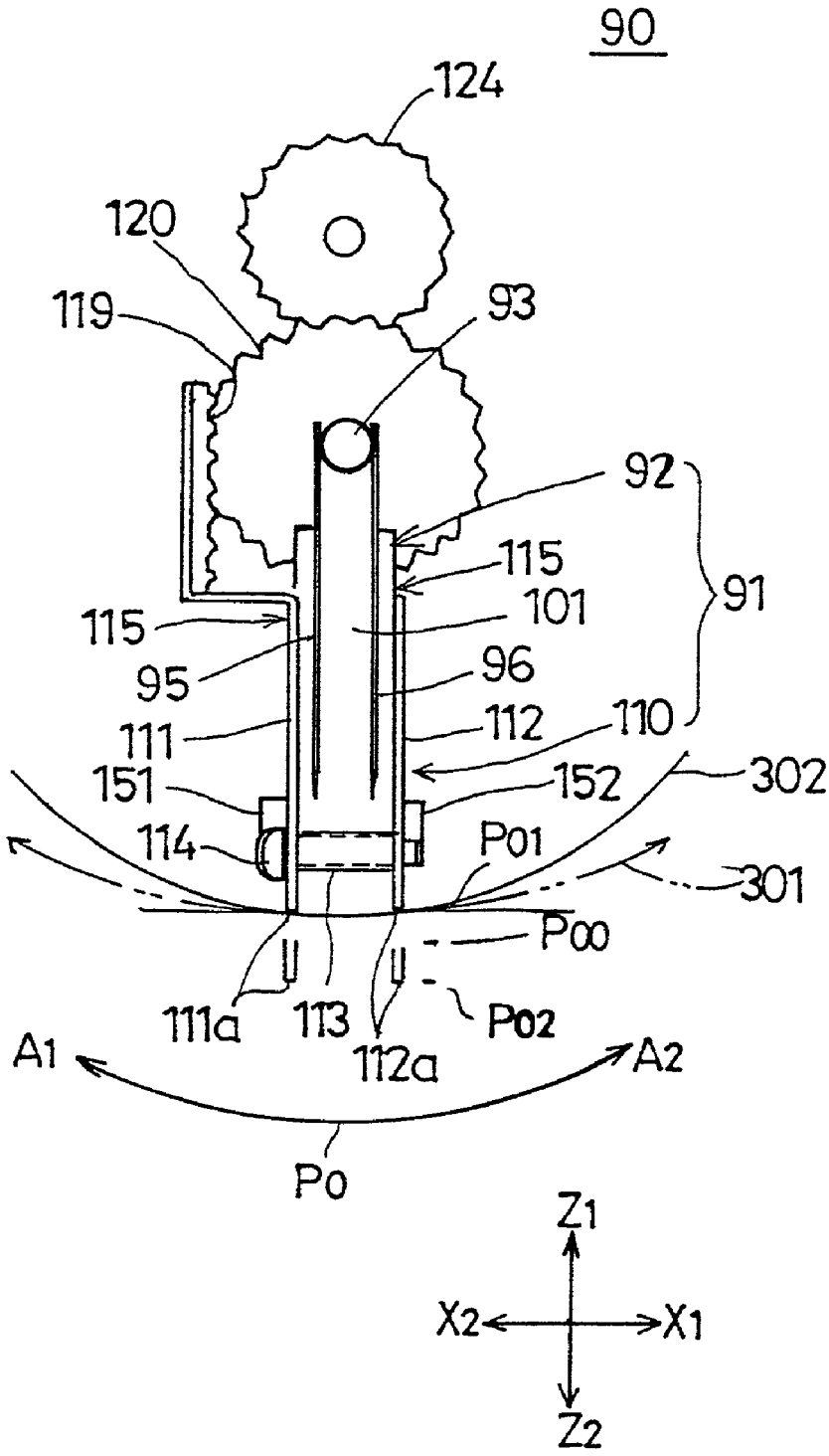
FIG. 7 is a side view of the continuous medium swinging mechanism of FIG. 5A viewed from the X1 side.

The sub-arm 110 is an auxiliary arm for the arm main body 92 and can be extended and retracted in a telescopic manner between the retracted position P01 and the extended position P02 extending towards the Z2-direction shown in FIG. 7. The sub-arm 110 swings with the arm main body 92.

Figure 8:
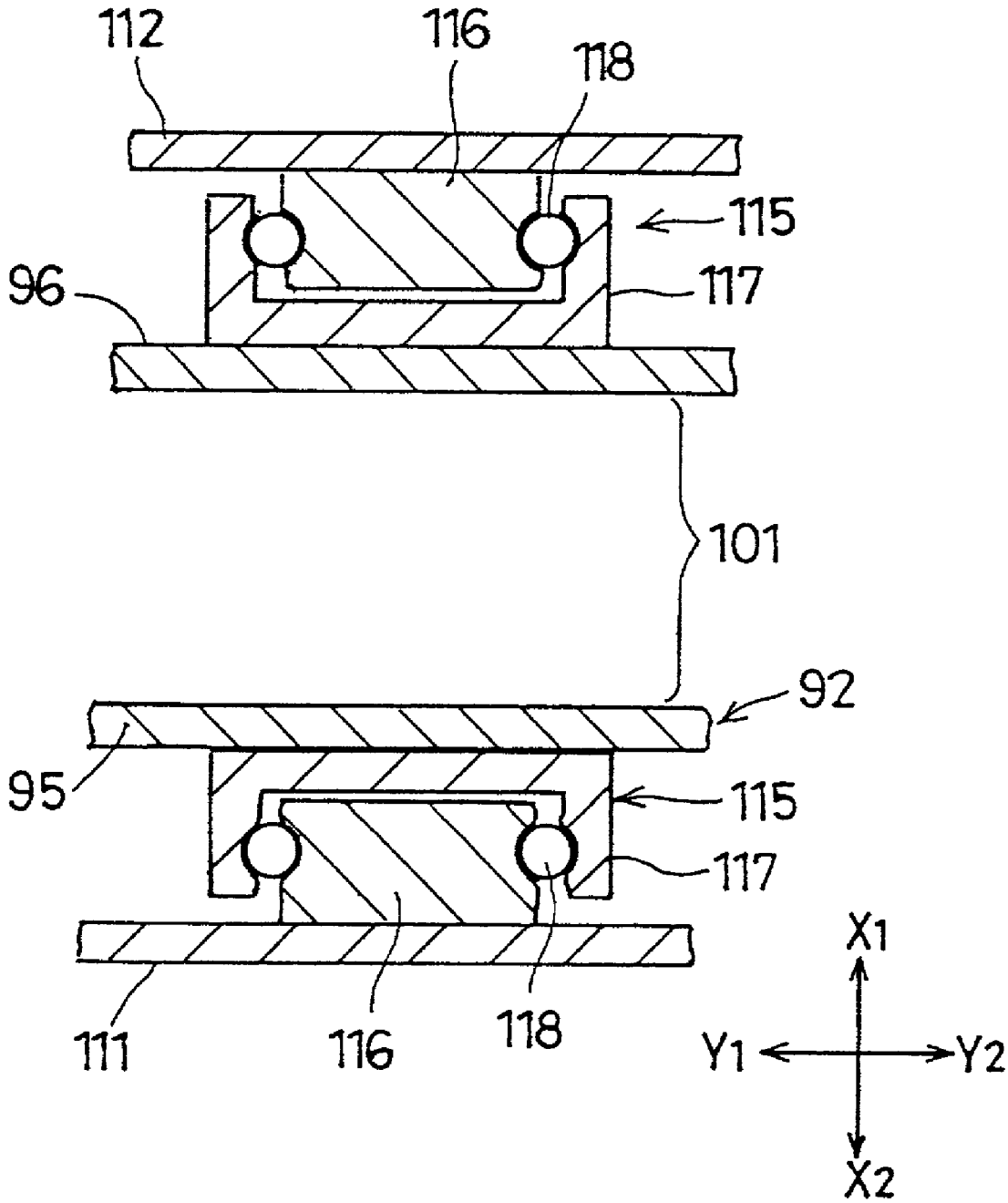
FIG. 8 is an enlarged cross-sectional view of the continuous medium swinging mechanism along line VIII-VIII shown in FIG. 6.

The sub-arm 110 has a structure that two plate members 111 and 112 are fixed by a screw 114 with a collar member 113 interposed between end parts in its longitudinal direction. The sub-arm 110 substantially surrounds the outer surface of the arm main body 92 and is guided by four guiding mechanisms 115 so as to be movable in the Z1-Z2 direction with respect to the arm main body 92. Thus the swing arm can be extended and retracted. As shown in the enlarged view of FIG. 8, the guiding mechanism 115 includes an inner rail 116, an outer rail 117 and a ball 118. A rack 119 is fixed on the plate members and engages with a pinion 120. The pinion 120 is supported on an inner side of the side-surface plate 97 by the bearing 121 so as to be coaxial with the shaft member 93.

When the swing arm 91 swings in the A1-direction, an edge part 112*a* in the Z2-direction of the plate member 112 presses and supports the continuous medium 1 and when the swing arm swings in the A2-direction, an edge part 111*a* in the Z2-direction of the plate member 111 presses and supports the continuous medium 1. When the swing arm 91 swings, the edge parts 111*a* and 112*a* traces a trajectory 301 shown in FIG. 7. The trajectory 301 is more linear compared to an arc 302 of a circle centered on the shaft 93.

The telescopic operation motor 123 is fixed on a bracket 122 fixed to the side-surface plates 97. A gear 124 is fixed on the telescopic operation motor 123. The gear 124 engages with the pinion 120.

The telescopic operation motor 123 is provided with a sub-arm home position detecting mechanism 125 for detecting home position P00 of the sub-arm 110.

Figure 5A:
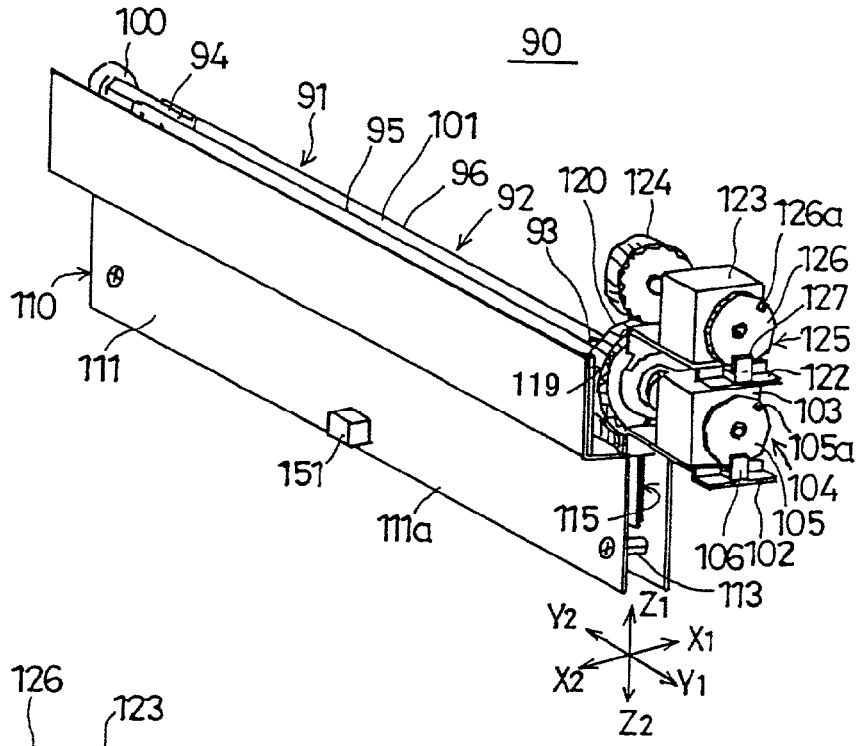
FIG. 5A is a perspective diagram showing a continuous medium swinging mechanism of the continuous medium folding device shown in FIG. 4.
Figure 5B:
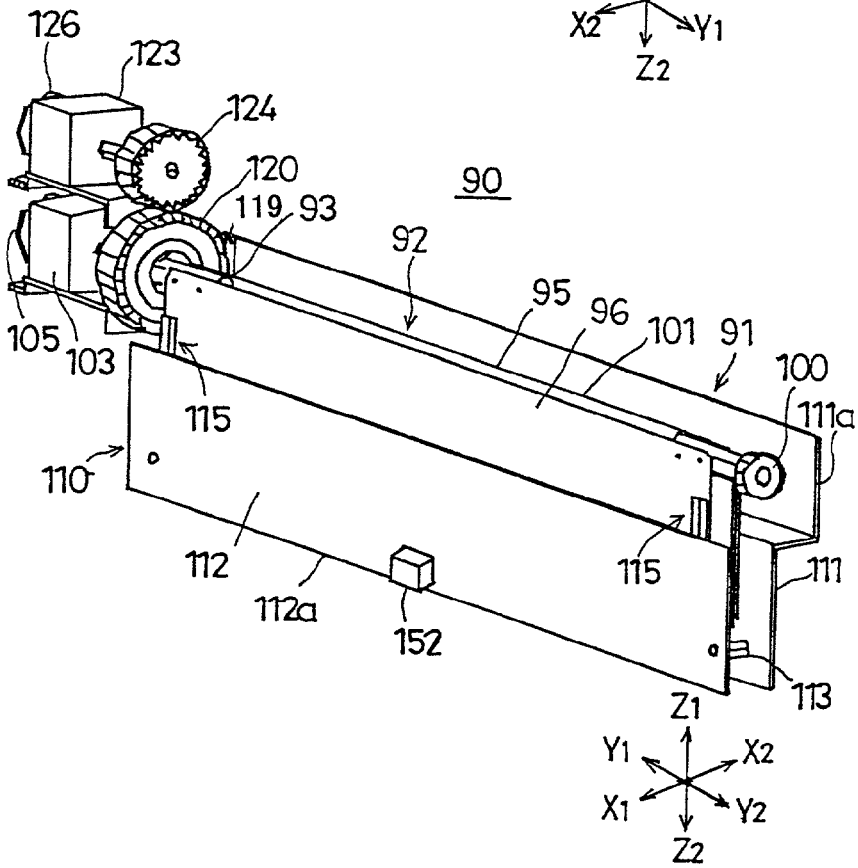
FIG. 5B is a perspective diagram showing the continuous medium swinging mechanism of FIG. 5A viewed in a different direction.
Figure 6:
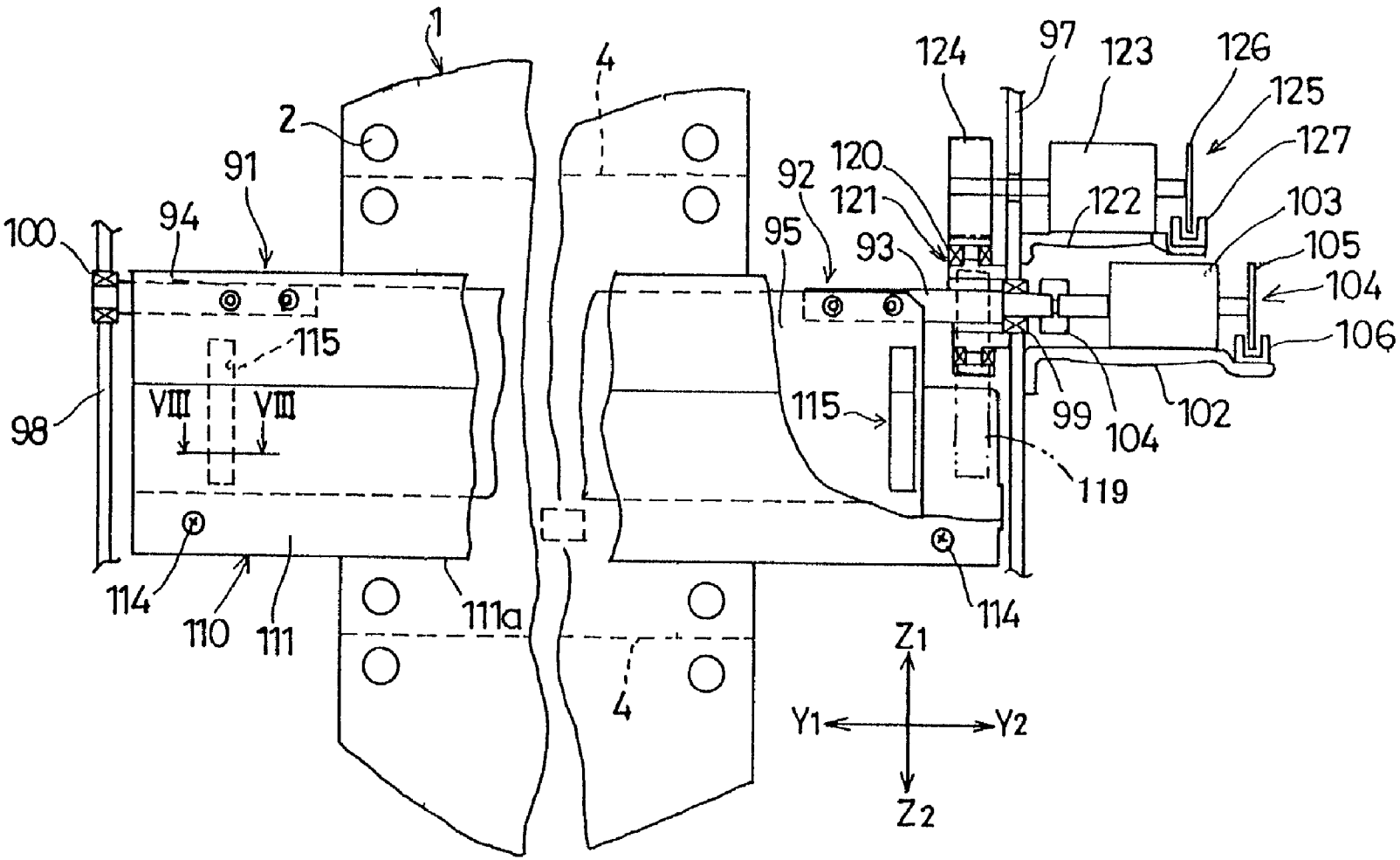
FIG. 6 is a side view of the continuous medium swinging mechanism of FIG. 5A viewed from the X2 side.

Referring to FIG. 5B, home position P00 of the sub-arm 110 is a position in the middle of the retracted position P01 and the extended position P02.

The sub-arm home position detecting mechanism 125 includes a notched disk 126 fixed to the shaft of the motor 123 and a photo-coupler 127 for detecting a notch 126*a* of the disk 126.

The swing operation motor 103 and the telescopic operation motor 123 are associated with each other and are driven in a reciprocating manner such that the continuous medium swaying mechanism 90 of the above-described structure operates as shown in FIGS. 9-12, 13A-13D and 14A-14D.

Figures 13A, 13B, 13C, 13D:
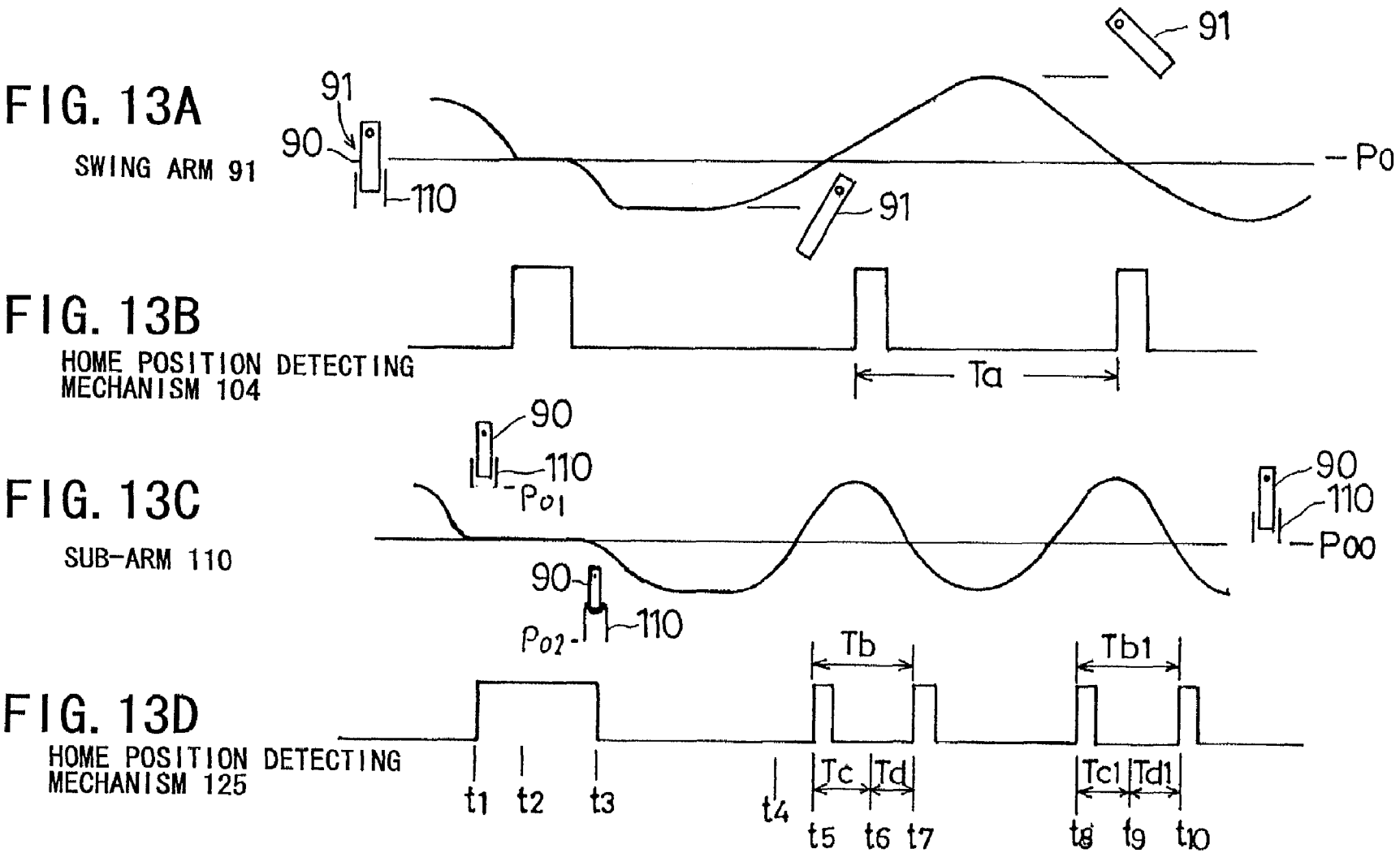
FIGS. 13A to 13D are diagrams for explaining an operation of the continuous medium swinging mechanism.
Figure 14A:
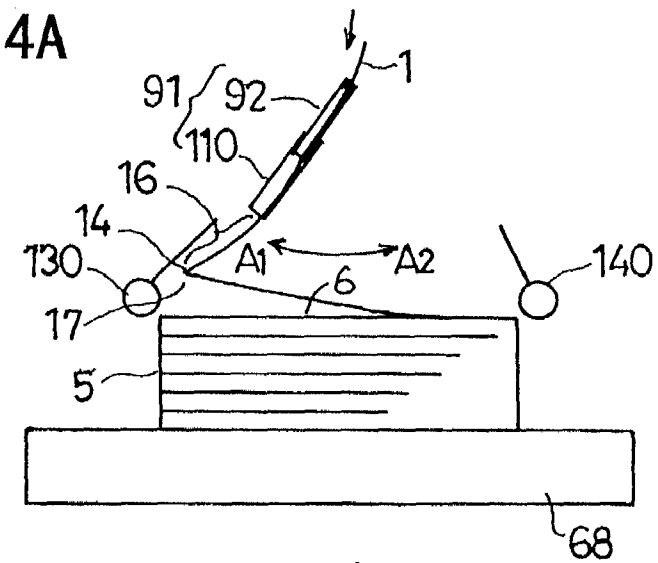
FIGS. 14A to 14D are diagrams showing a folding operation of the continuous medium.

FIG. 13A shows a swing of the swing arm 91 in the A1-A2 direction and FIG. 13B shows an output of the swing arm home position detecting mechanism 104. FIG. 13C shows a manner in which the sub-arm 110 is extended and retracted and FIG. 13D shows an output of the sub-arm home position detecting mechanism 125. FIGS. 14A to 14D show various steps of an operation of the continuous medium swaying mechanism 90 and the continuous medium folding line pressing mechanism 130, 140. FIG. 14A shows an initial state.

Figure 9:
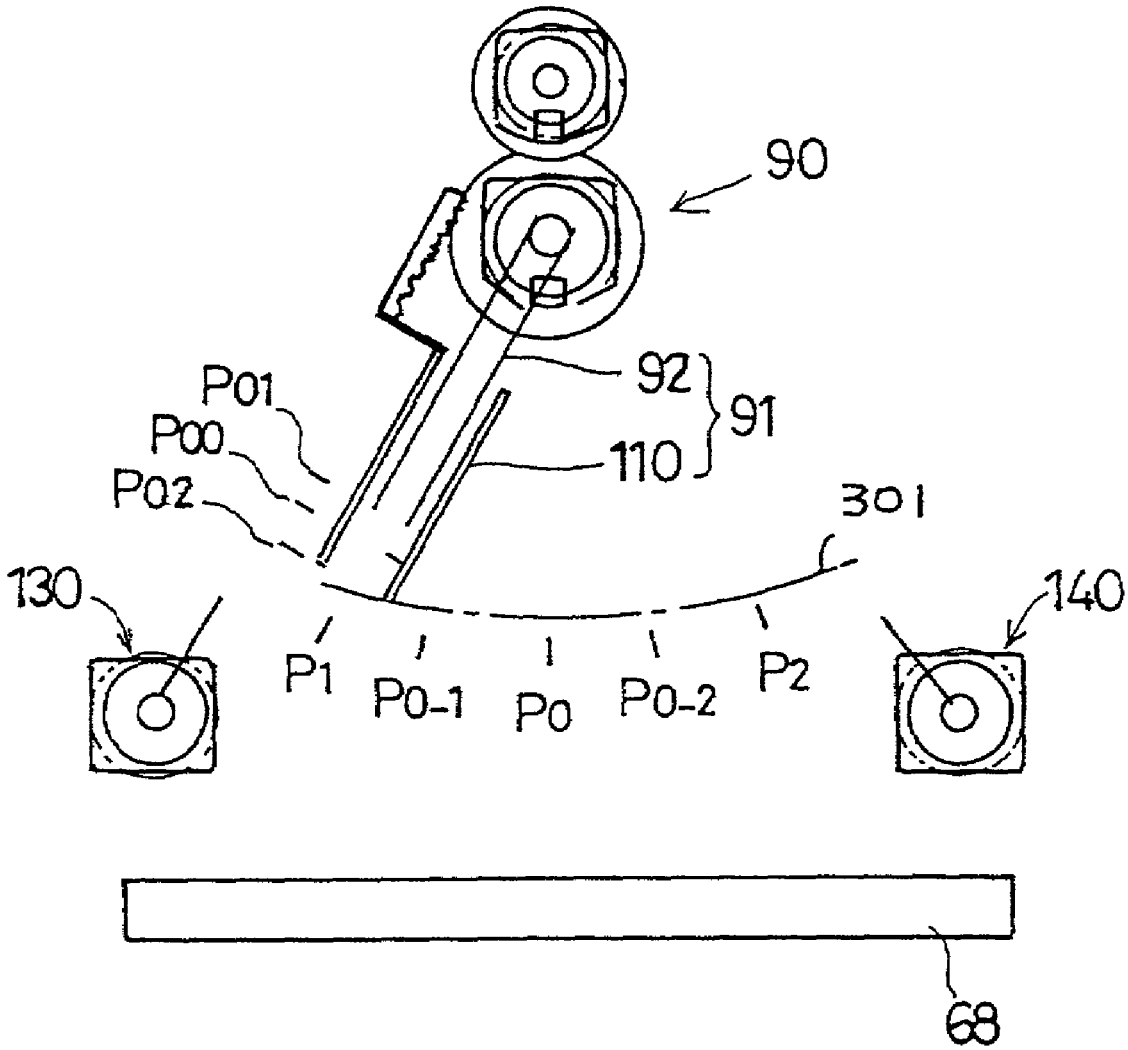
FIG. 9 is a side view of the continuous medium swinging mechanism in a state where a swing arm has reached to point P1.

The swing arm 91 firstly reaches its home position P0 as shown in FIG. 4 and then, starting from this home position P0 as a reference position, moves to the initial position P1 corresponding to the sheet folding length as shown in FIGS. 9 and 14A (see FIG. 13A, time period between time t0 and t3.) Then, the swing operation motor 103 is driven in a reciprocating manner at predetermined speed. The swing arm 91 starts the swinging operation at a predetermined period over a predetermined region. As shown in FIGS. 9 to 12, the swing arm 91 swings between positions P1 and P2 in the A1-A2 direction. The swinging operation of the swing arm 91 is performed while determining whether the swing is properly performed by detecting the passage of the swing arm 91 through home position P0 and by monitoring time period Ta between the previous time t6 and the current time t9 shown in FIGS. 13A and 13B.

The sub-arm 110 firstly reaches its home position P00 as shown in FIG. 13C and then, starting from this home position P00 as a reference position, moves to the extended (initial) position P02 determined by the thickness of the continuous medium 1 (see FIGS. 9 and 13C, time period between time t1 and t3.) Then, the telescopic operation motor 114 is driven in a reciprocating manner at predetermined speed. As shown in FIG. 13C and FIGS. 9 to 12, the sub-arm 110 starts a swinging operation between the retracted position P01 and the extended (initial) position P02.

Figure 10:
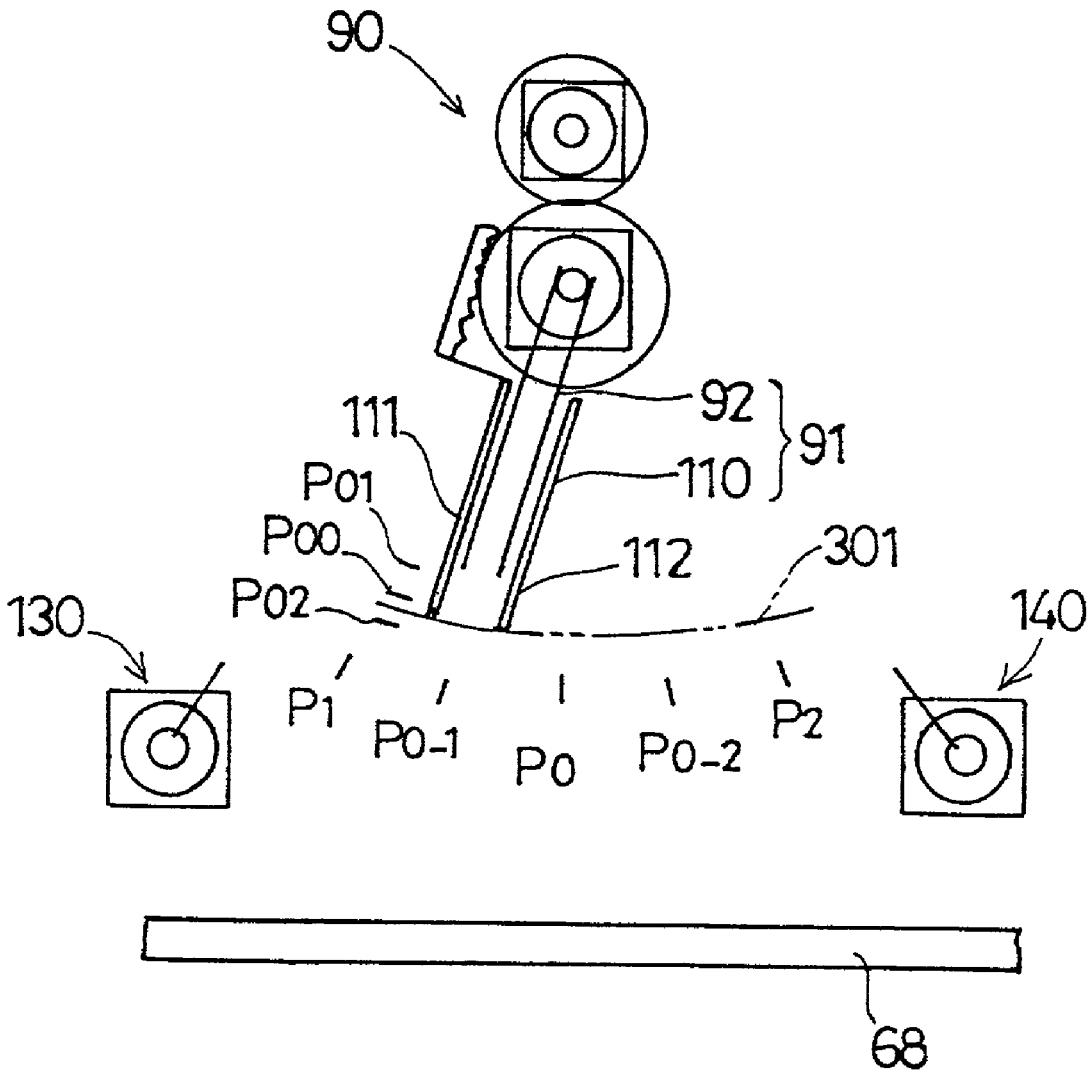
FIG. 10 is a side view of the continuous medium swinging mechanism in a state where the swing arm has reached to point P0-1.
Figure 11:
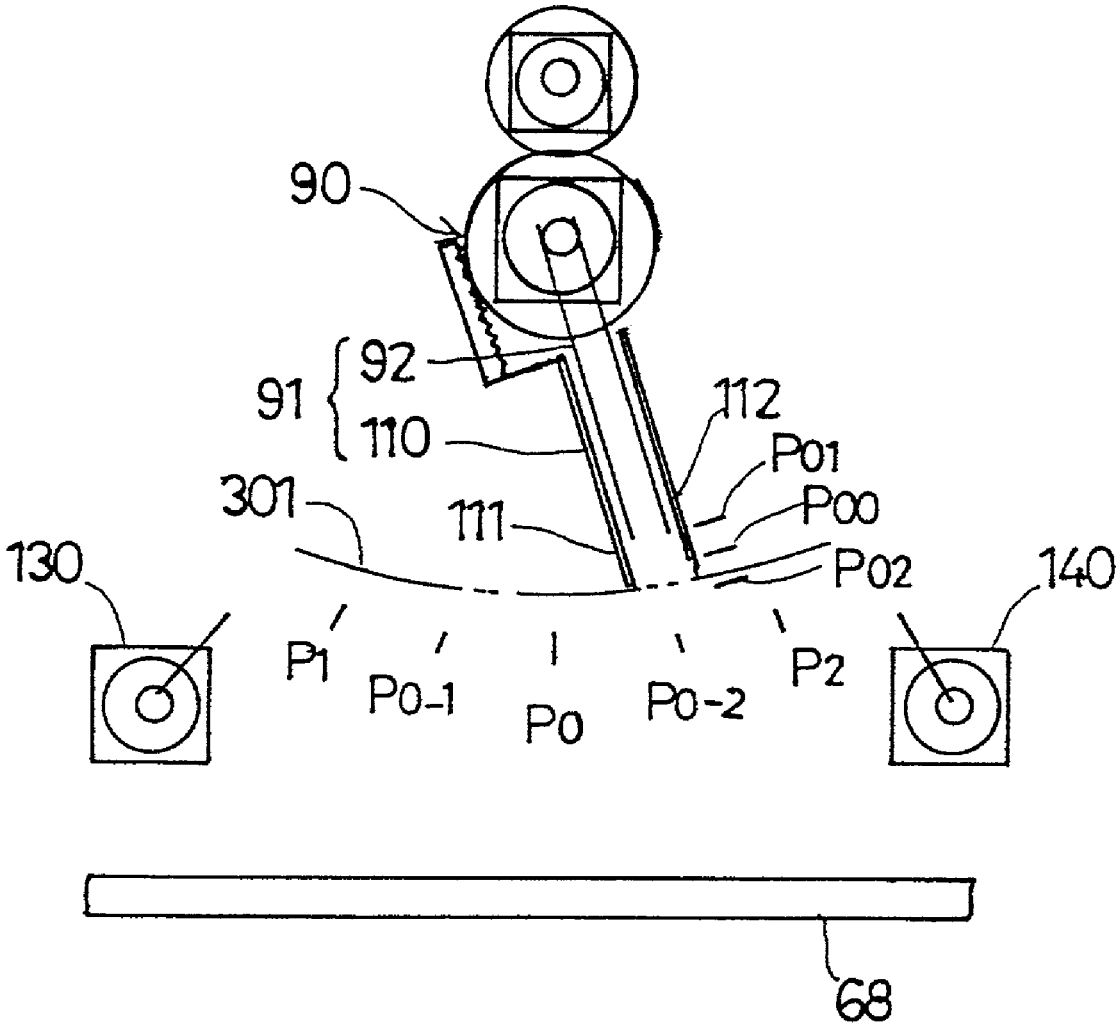
FIG. 11 is a side view of the continuous medium swinging mechanism in a state where the swing arm has reached to point P0-2.
Figure 12:
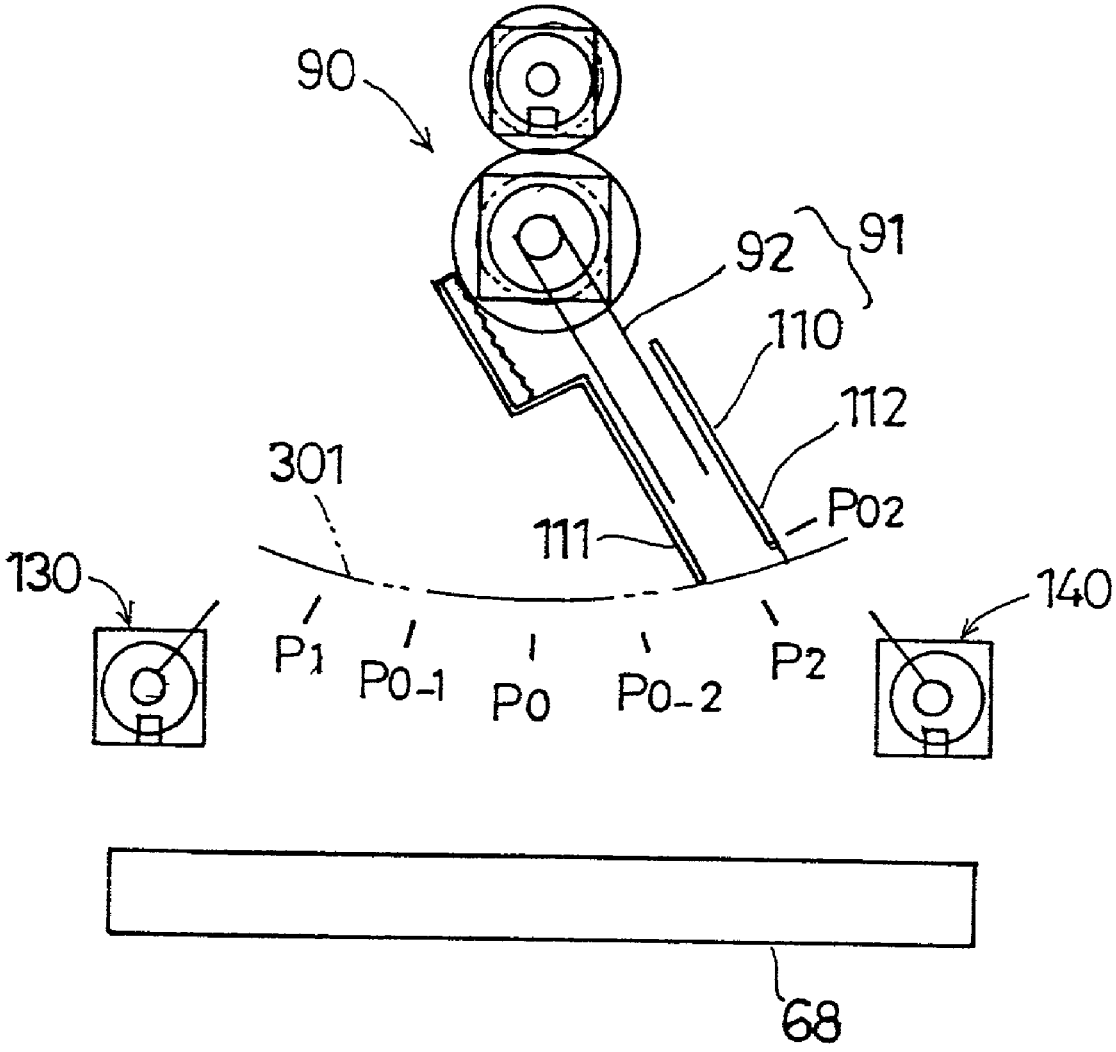
FIG. 12 is a side view of the continuous medium swinging mechanism in a state where the swing arm has reached to point P2.

As shown in FIG. 7, as the swing arm 91 passes home position P0, the sub-arm 110 reaches to the retracted position P01. As shown in FIGS. 9 and 12, when the swing arm 91 reaches to positions P1 and P2, the sub-arm 110 reaches to the most extended position P02. As shown in FIG. 10, when the swing arm 91 passes an intermediate position P0-1 between home position P0 and position P1, the sub-arm 110 passes home position P00. As shown in FIG. 11, also when the swing arm 91 passes an intermediate position P0-2 between home position P0 and position P2, the sub-arm 110 passes home position P00.

The swinging operation of the sub-arm 110 is performed while determining whether the swing is properly performed by detecting the passage of the sub-arm 110 through home position P00 and by monitoring time period Tb between the previous time t5 and the current time t7 shown in FIGS. 13C and 13D.

The swing arm 91 and the sub-arm 110 operates in a synchronizing manner by monitoring time periods Tc and Td between times t5, t7, respectively, at which the sub-arm 110 passes home position P00 and time t6 at which the swing arm 91 passes home position P0 (see FIGS. 13A to 13D, time period between time t5 and t7).

In the present embodiment, the continuous medium 1 is fed downwardly through the arm main body 92 and through the passage 101 in the sub-arm 110 and proceeds to the stacker table 67. As shown in FIGS. 14A to 14D, the continuous medium 1 is swayed in the X1-X2 direction by the sub-arm 110 provided at the tip of the swing arm 91 and is accordion-folded onto the stacker table 68.

Figure 14B:
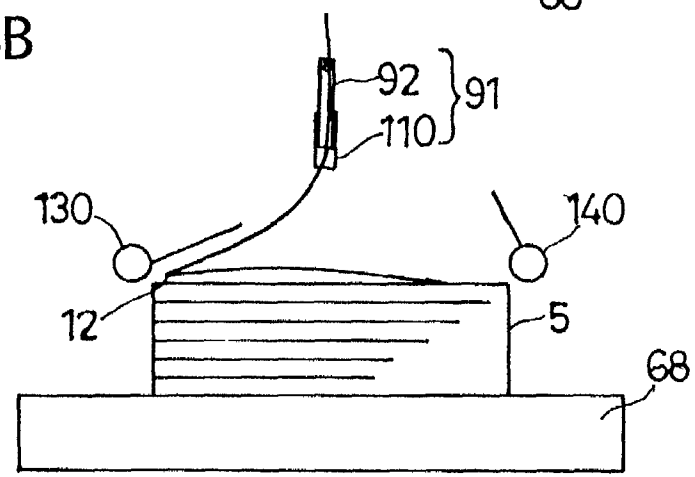
Figure 14C:
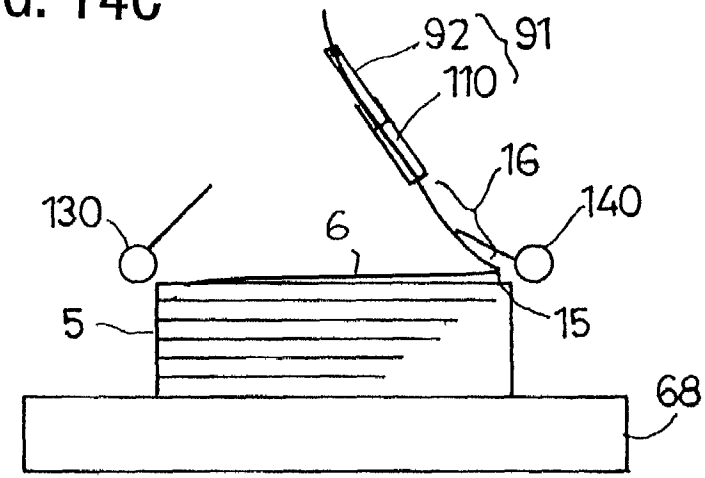

Here, as shown in FIGS. 14A and 14C, when the swing arm 91 swings, the sub arm 110 moves so as to protrude from the tip of the arm main body 92. Accordingly, the swing arm 91 is extended. When the swing arm 91 swings, the edge parts 111*a*, 112*a* form a trajectory approximated as the straight line indicated by reference 301 in FIG. 7, while maintaining a small distance against the top surface 6 of the continuous medium 5 which is folded and stacked on the stacker table 68. Thus, the edge parts 111*a* and 112*a* supports positions near the transverse perforations 4 of the continuous medium 1. Accordingly, an area of a part 16 not supported by the sub-arm 110 and thus subjected to a wind pressure becomes small and a bending force on the protruded part of the continuous medium 1 also becomes small. As a result, even when the thickness of the continuous medium 1 is smaller than the conventional continuous medium, the continuous medium 1 will not be bent as shown in FIG. 1 but will be folded at the positions of the perforations 4 as indicated by reference 17.

Referring now to FIG. 4, the continuous medium fold line pressing mechanisms 130, 140 will be described.

The continuous medium fold line pressing mechanism 130 includes a flap 131, a pulse motor 132 for moving the flap 131 in a reciprocating manner between home position P000 and position P001 and a flap home position detecting mechanism 133.

Home position P000 of the flap 131 is a position where the flap is held at an angle upwardly. Position P001 is a position where the flap 131 is held horizontally and presses the fold line 12 of the continuous medium.

The flap home position detecting mechanism 133 includes a notched disk 134 fixed to the shaft of the motor 132 and a photo-coupler 135 for detecting a notch 134*a* of the disk 134.

The continuous medium fold line pressing mechanism 140 has the same structure as the above-described continuous medium fold line pressing mechanism 130. The continuous medium fold line pressing mechanism 140 includes a flap 141, a pulse motor 142 for pivoting the flap 141 in a reciprocating manner between home position P0000 and position P0001 and a flap home position detecting mechanism 143. The flap home position detecting mechanism 143 includes a notched disk 144 fixed to the shaft of the motor 142 and a photo-coupler 145 for detecting a notch 144*a* of the disk 144.

Normally, the flaps 131 and 141 takes home positions P000, P0000 where they are held at an angle upwardly such that the fold lines 12 and 13 of the continuous medium can be accommodated under the flaps 131 and 141.

Figure 14D:
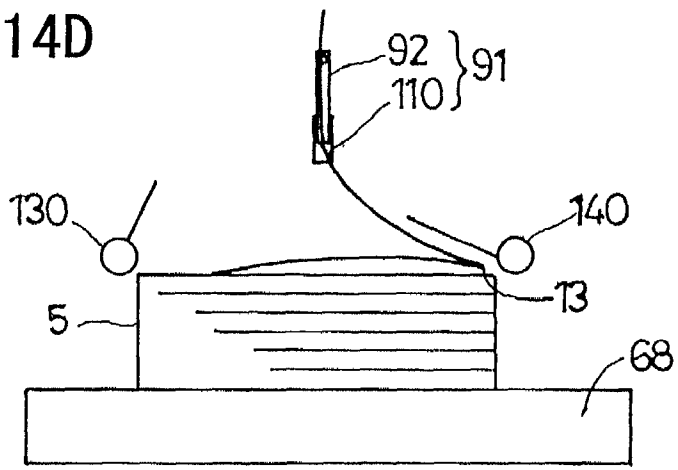
Figure 15:
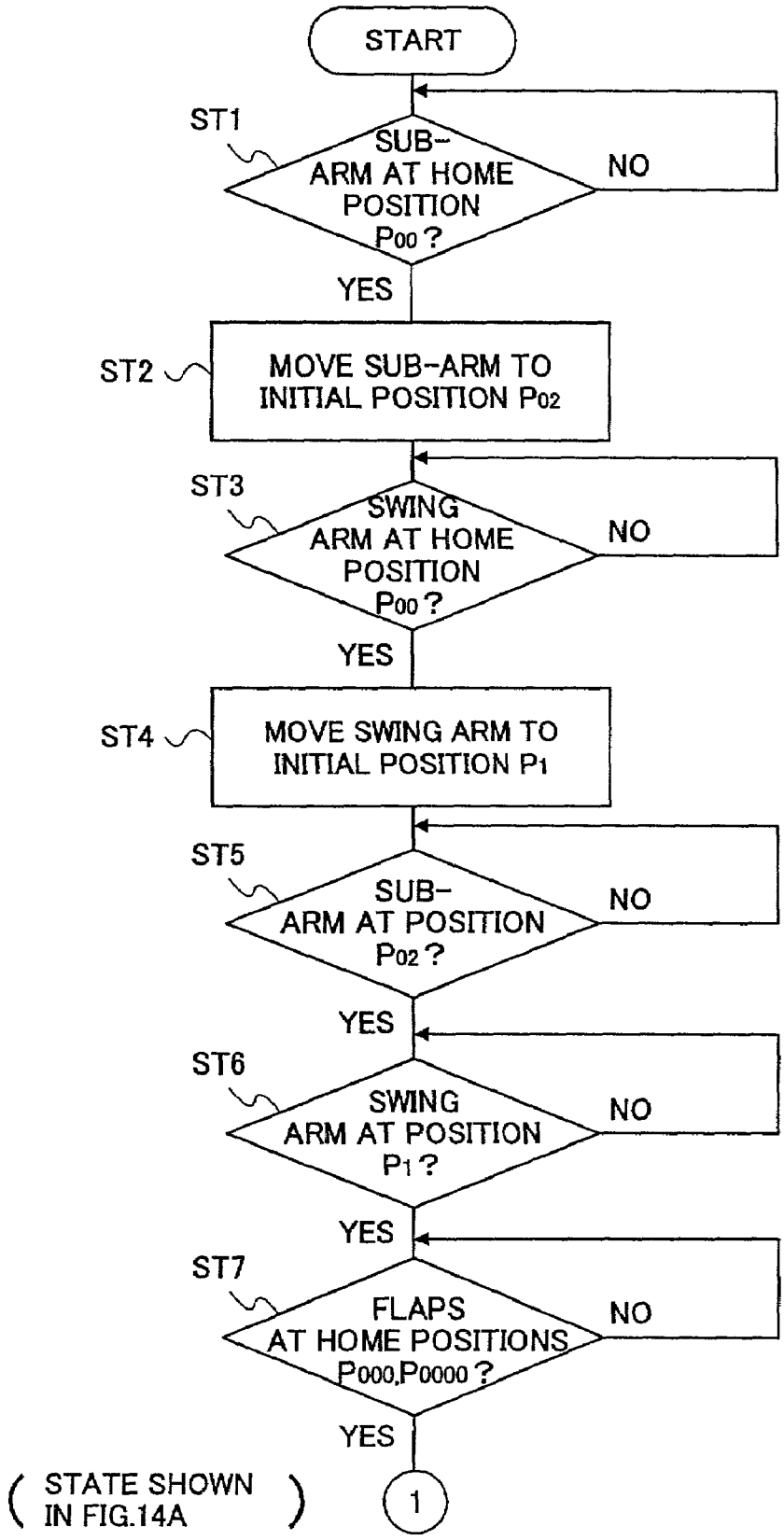
FIG. 15 is a first portion of a flowchart of an operation of the control circuit shown in FIG. 4 while folding the continuous medium.
Figure 16:
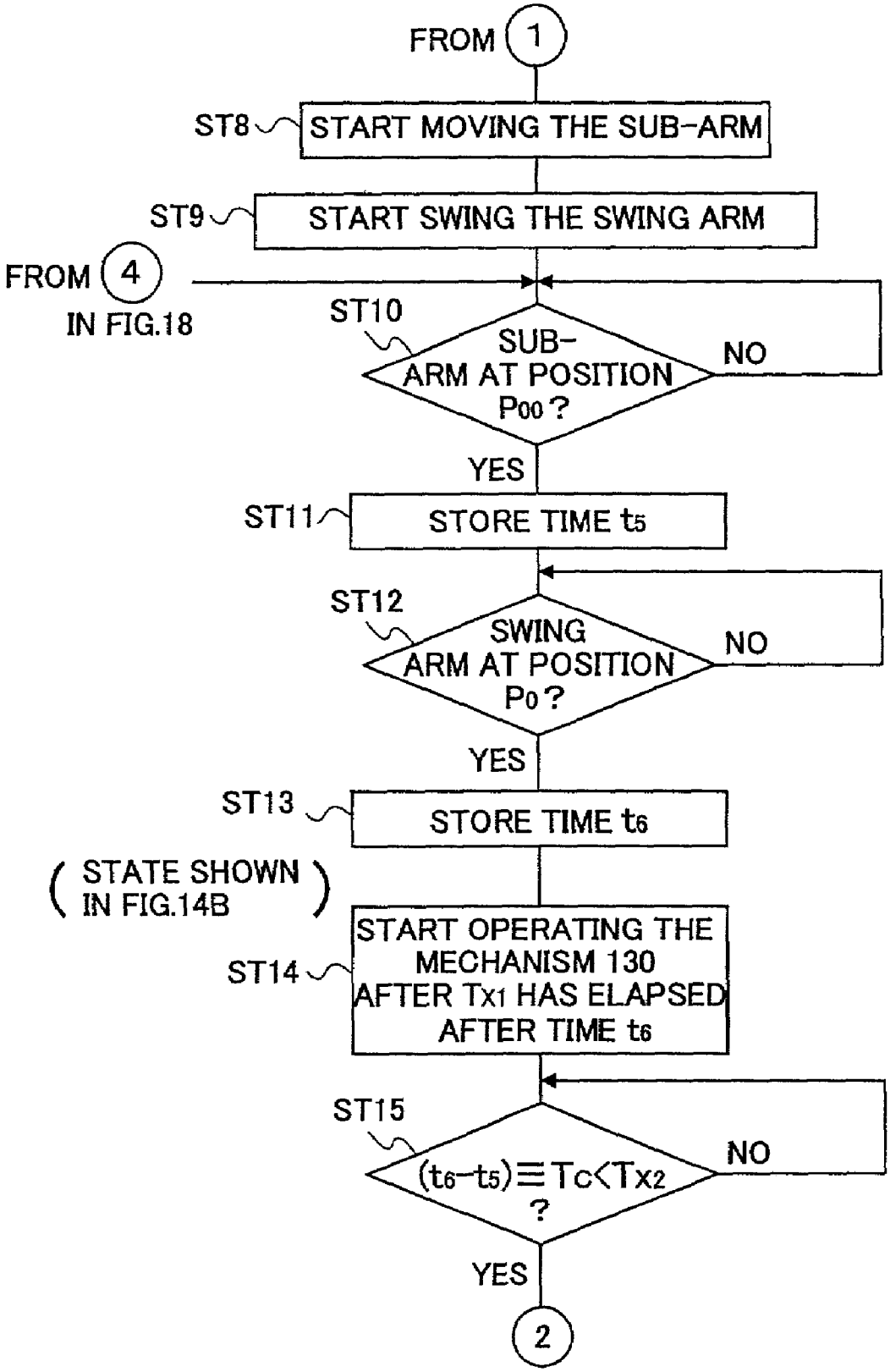
FIG. 16 is a second portion of a flowchart of an operation of the control circuit shown in FIG. 4 while folding the continuous medium.
Figure 17:
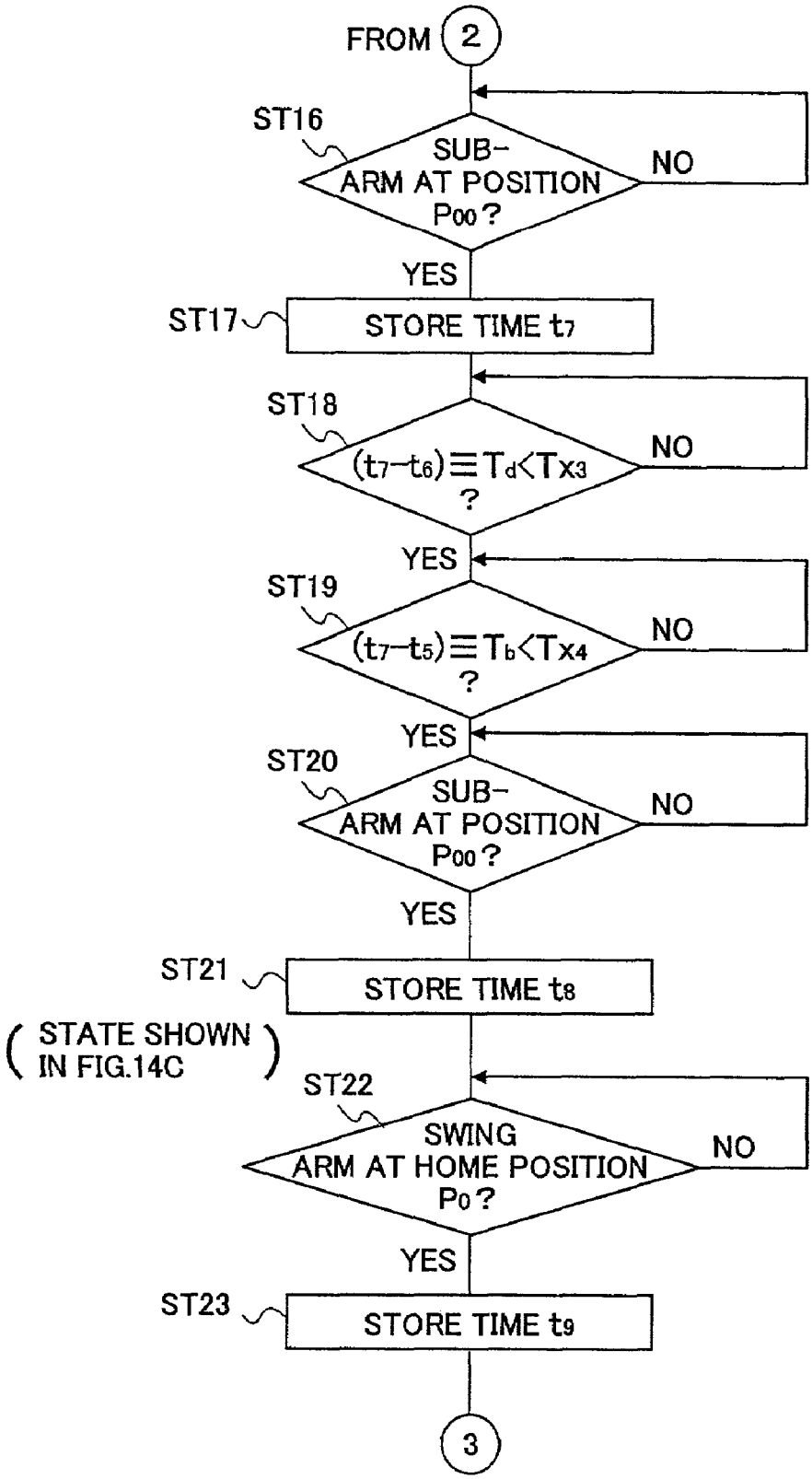
FIG. 17 is a third portion of a flowchart of an operation of the control circuit shown in FIG. 4 while folding the continuous medium.
Figure 18:
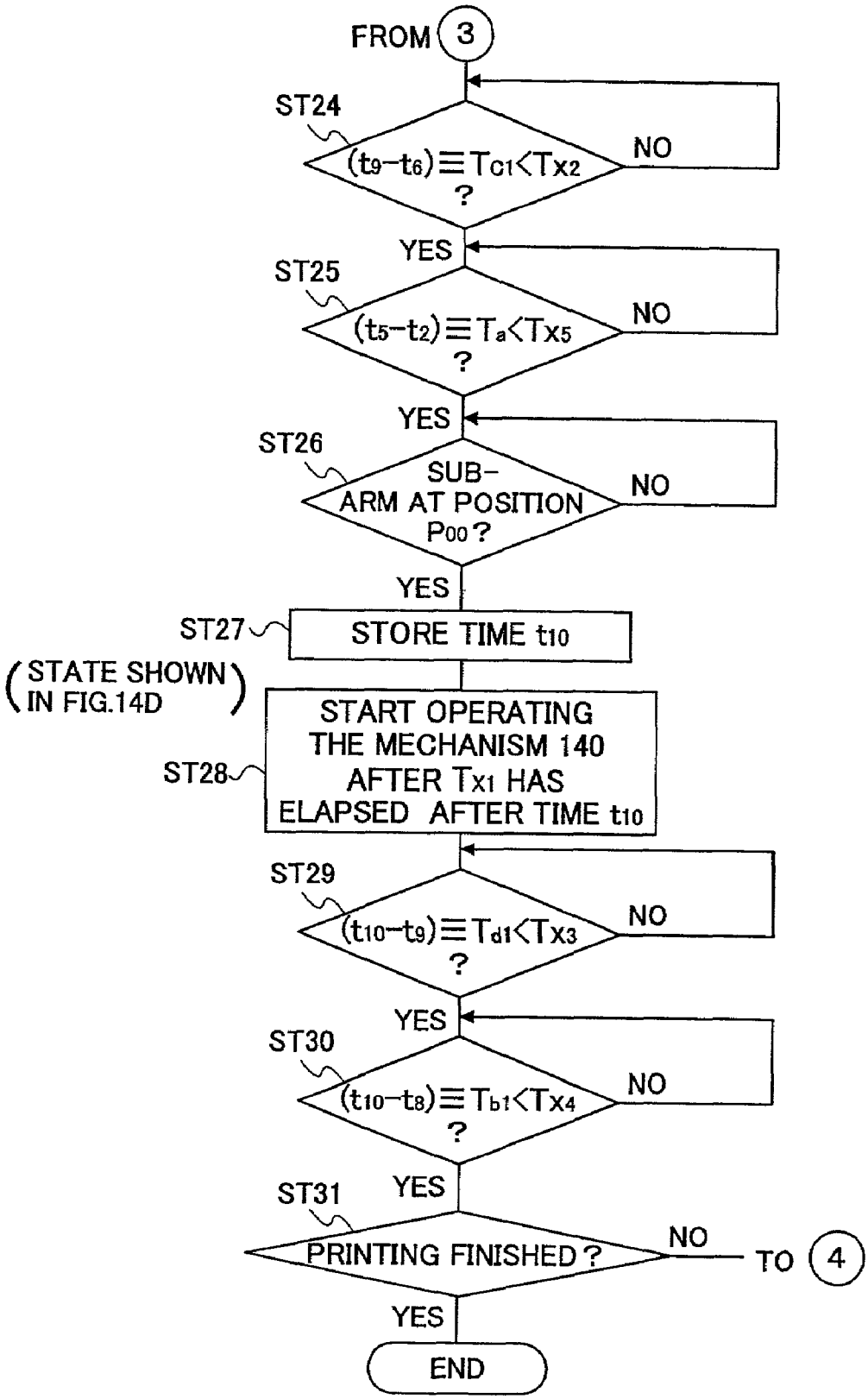
FIG. 18 is a fourth portion of a flowchart of an operation of the control circuit shown in FIG. 4 while folding the continuous medium.

As shown in FIGS. 14A and 14B, when the swing arm 31 completes its movement in the A1-direction and starts a reverse movement in the A2-direction, the pulse motor 132 is initiated such that the flap 131 is pivoted in the B1-direction up to position P001 and presses the fold line 12 of the continuous medium. Immediately after this, the pulse motor 132 is driven in a reverse manner such that the flap 131 is pivoted in the B2-direction and brought back to its home position P000. As shown in FIGS. 14C and 14D, when the swing arm 31 completes its movement in the A2-direction and starts a reverse movement in the A1-direction, the pulse motor 142 is initiated such that the flap 141 is pivoted in the C1-direction up to position P0001 and presses the fold line 13 of the continuous medium. Immediately after this, the pulse motor 142 is driven in a reverse manner such that the flap 141 is pivoted in the C2-direction and brought back to its home position P0000. Thus, the pulse motors 132 and 142 are alternately driven so as to be in synchronous with the reciprocating pivotal movement of the swing arm 31, such that the flaps 41 and 51 are alternately pivoted and presses the fold lines 12 and 13 of the continuous medium as shown in FIGS. 14A to 14D.

As shown in FIGS. 4, 5A and 5B, distance-measuring sensors 151 and 152 are provided on outer surfaces of the plate members 111 and 112, respectively, of the sub-arm 110. The distance-measuring sensors 151 and 152 are provided near the edge parts 111*a* and 112*a* of the outer surfaces of the plate members 111 and 112, respectively. The distance-measuring sensors 151 and 152 emit light in a direction beyond the tip of the swing arm 91, detect light reflected at the sheet and measure the distance between the tip of the sub-arm 110 to the sheet. The distance-measuring sensors 151 and 152 are connected to a distance sensor circuit 154 vie a switching circuit 153.

Also, as shown in FIG. 4, the continuous medium folding machine 80 is provided with an elevating mechanism 160 for vertically moving the stacker table 68. The stacker table elevating mechanism 160 is driven by a motor 161.

The continuous medium folding machine 80 is also provided with a sensor 155 for detecting the level of the stacker table 68 and a sensor circuit 156.

Also, as shown in FIG. 4, the continuous medium folding machine 80 is provided with a control circuit 170, motor drive circuits 171 to 175 and sensor circuits 176 to 179.

In order to operate the continuous medium folding machine 80, the control circuit 170 determines the timings based on information from the sensor circuits 176 to 179 and the motor drive circuits 171 to 175 are actuated to operate the continuous medium folding machine 80. The control circuit 170 is a microcomputer.

FIGS. 15 to 18 are diagrams showing parts of the flowchart of an operation of the control circuit 170.

When a print start signal is input, the control circuit 170 operates as follows.

Firstly, it is determined whether the sub-arm 110 is at its home position P00 (ST1). Then, taking home position as the reference, the pulse motor 123 is driven for a predetermined number of steps according to the thickness and width of the continuous medium, so as to move the sub-arm 110 to the initial position P02 (ST2). See FIGS. 13C and 13D, time period between time t1 and t3.

Then, it is determined whether the swing arm 31 is at its home position P0 (ST3). Taking home position as the reference, the pulse motor 103 is driven for a predetermined number of steps according to a factor such as the folding length of the continuous medium, so as to move the sub-arm 31 to the initial position P1 (ST4). See FIGS. 13A and 13B, time period between time t0 and t3.

Then, it is determined whether the sub-arm 110 has moved to the initial position P02 (ST5, see FIGS. 13C and 13D, at time t3). Then, it is determined whether the flaps 131 and 141 are at home positions P000, P0000, respectively (ST7).

At this stage, the continuous medium folding device 80 is in a state shown in FIG. 14A.

Then, the sub-arm 110 is moved towards the retracting direction (ST8). The swing arm 31 starts a swing operation in the A2-direction (ST8, ST9, see FIGS. 13A to 13D, time period between time t3 and t4).

Then, it is determined whether the sub-arm 110 under its extracting operation has reached to its home position P00 (ST10). If the result of ST10 is YES, the time t5 is recorded (ST11). See FIGS. 10C and 10D, time t5.

It is determined whether the swing arm 31 has reached to its home position P0 (ST12). If the result of ST12 is YES, the time t6 is recorded (ST13). See FIGS. 13A and 13B, time t6.

At this stage, the continuous medium folding device 80 is in a state shown in FIG. 14B.

After a predetermined time Tx1 has elapsed after time t6 at which the swing arm 31 has reached to its home position P0, the operation of the continuous medium fold line pressing mechanism 130 is initiated (ST14).

Then, it is determined whether (t6−t5)≡Tc has a value less than or equal to a predetermined value Tx2 (ST15).

If (t6−t5)≡Tc has a value less than or equal to a predetermined value Tx2, it is determined whether the sub-arm 110 under extension operation has reached to its home position P00 again (ST16). If the result of ST16 is YES, the time t7 is recorded (ST17). See FIGS. 13C and 13D, time t7.

Then, it is determined whether (t7−t6)≡Td has a value less than or equal to a predetermined value Tx3 (ST18). If the result of ST18 is YES, it is determined whether (t7−t6)≡Td has a value less than or equal to a predetermined value Tx4 (ST19).

If (t7−t5)≡Tb has a value less than or equal to a predetermined value Tx4, it is determined whether the sub-arm 110 under retraction operation has reached to its home position P00 again (ST20). If the result of ST20 is YES, the time t8 is recorded (ST21). See FIGS. 13C and 13D, time t8.

At this stage, the continuous medium folding device 80 is in a state shown in FIG. 14C.

Then, it is determined whether the swing arm 31 under its swinging operation in the A1-direction has reached to its home position P0 (ST22). If the result of ST22 is YES, the time t9 is recorded (ST23). See FIGS. 13A and 13B, time t9.

Then, it is determined whether (t9−t8)≡Tc1 has a value less than or equal to a predetermined value Tx2 (ST24).

If (t9−t8)≡Tc1 has a value less than or equal to a predetermined value Tx2, it is determined whether (t9−t6)≡Ta has a value less than or equal to a predetermined value Tx5 (ST25).

If (t9−t6)≡Ta has a value less than or equal to a predetermined value Tx5, it is determined whether the sub-arm 110 under extension operation has reached to its home position P00 again (ST26). If the result of ST26 is YES, the time t10 is recorded (ST27). See FIGS. 13C and 13D, time t10.

At this stage, the continuous medium folding device 80 is in a state shown in FIG. 13D.

After a predetermined time Tx1 has elapsed after time t10 at which the swing arm 31 has reached to its home position P0, the operation of the continuous medium fold line pressing mechanism 140 is initiated (ST28).

Then, it is determined whether (t10−t9)≡Td1 has a value less than or equal to a predetermined value Tx3 (ST29).

If (t10−t9)≡Td1 has a value less than or equal to a predetermined value Tx3, it is determined whether (t10−t8)≡Tb1 has a value less than or equal to a predetermined value Tx4 (ST30).

If (t10−t8)≡Tb1 has a value less than or equal to a predetermined value Tx4, it is determined whether the printing has finished. Then, the operation returns to ST10 shown in FIG. 16.

Now, an operation relate to a sensor 15 for measuring the thickness of the continuous medium 1 shown in FIG. 4 will be described.

The electrophotographic printer 60 is provided with a continuous medium thickness measuring sensor 150 for measuring the thickness of the loaded continuous medium 1. In accordance with information from the sensor 150, the control circuit 150 operates and changes the pivoting angle of the telescopic operation motor 114. When a thin continuous medium 1 is used, the pivoting angle of the telescopic operation motor 114 is increased such that the distance of extension of the sub-arm 110 becomes larger than for the continuous medium 1 having a normal thickness. Accordingly, the continuous medium 1 will not be bent as shown in FIG. 1 and will be properly folded at the transverse perforations 4.

Figure 2:
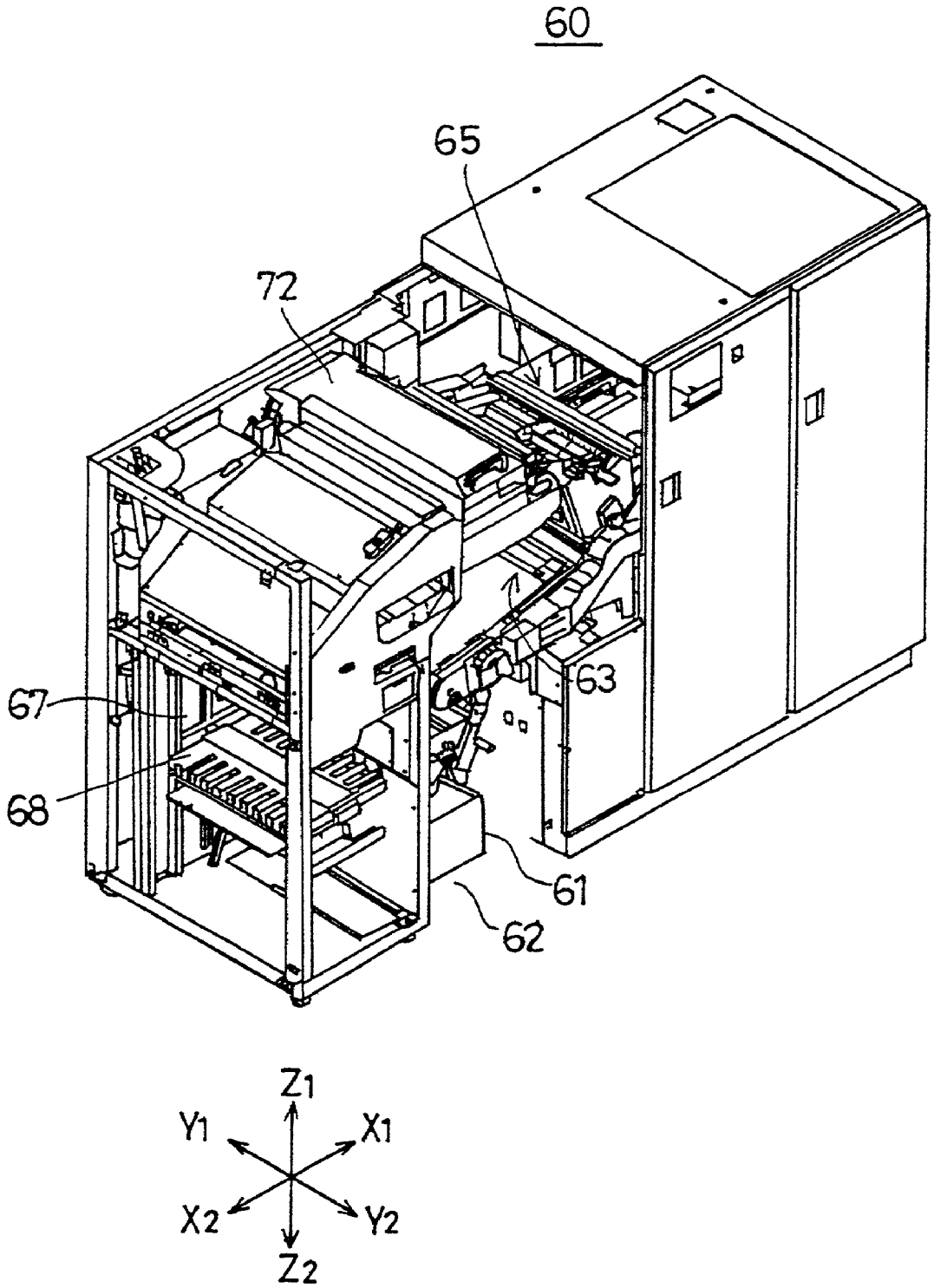
FIG. 2 is a perspective view of an electrophotographic printer adopting a continuous medium folding device of an embodiment of the present invention, shown with a part of its cover being removed.
Figure 3:
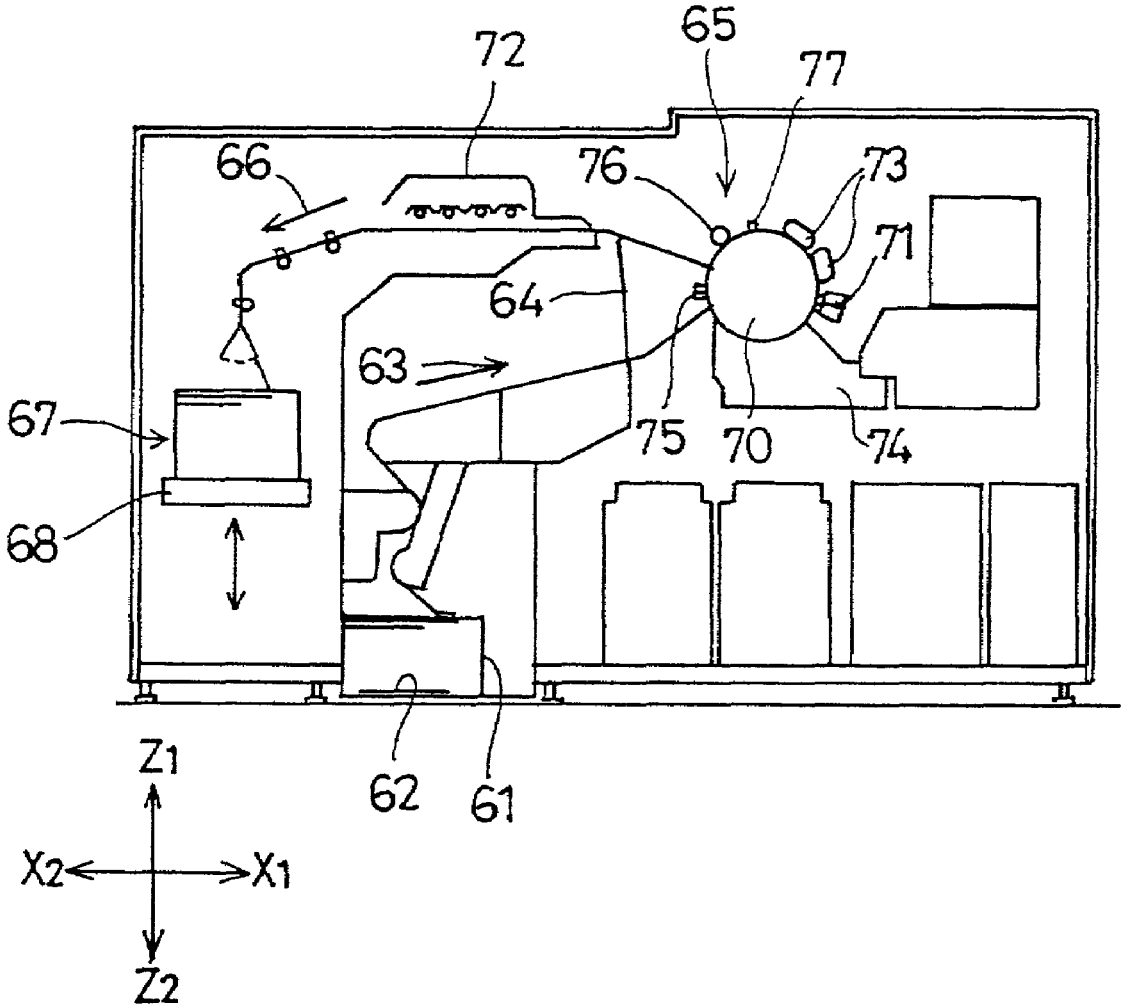
FIG. 3 is a schematic diagram showing the electrophotographic printer of FIG. 2.

The continuous medium folding device 80 shown in FIG. 80 is also provided with a back-up capability for preventing an occurrence of jamming in case where the continuous medium 1 is bent as shown in FIG. 1.

Now, an operation of preventing an occurrence of jamming will be described.

Referring to FIG. 4, the switching circuit 153 switches in response to the swing direction of the swing arm 91. When the swing arm 91 swings through a maximum angle in the A1-direction, the sensor circuit 154 is supplied with a signal from the distance measuring sensor 152 located on the home position P0 side. When the swing arm 91 swings through a maximum angle in the A2-direction, the sensor circuit 154 is supplied with a signal from the distance measuring sensor 151 located on the home position P0 side. That is to say, among the distance measuring sensors 151 and 152, the measured distance data of the distance measuring sensor located at the home position P0 side with respect to the swing arm 91 is utilized. This is because it is the distance measuring sensor located on the home position P0 side with respect to the swing arm 91 that opposes the bent portion of the continuous medium 1.

The control circuit 170 compares the measured distance data from the sensor circuit 154 with the predetermined value and determines whether there a bent has occurred in the continuous medium 1.

Figure 19A:
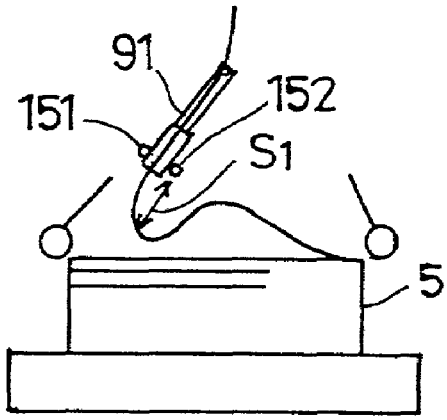
FIGS. 19A to 19E are diagrams for explaining an operation for preventing an occurrence of jamming of the continuous medium folding device.

As shown in FIG. 19A, when the continuous medium 1 bends as indicated by reference 15, the data of the distance S1 measured by the distance measuring sensor 152 will be smaller than a normal case. Thus, the control circuit 170 recognizes that a bend has occurred in the continuous medium 1.

Then, the control circuit 170 outputs an emergency stop signal and the electrophotographic printer 60 stops the printing operation. The feeding of the continuous medium 1 is stopped and the swing operation of the swing arm 91 is stopped. Accordingly, an occurrence of jamming is prevented.

Figure 19B:
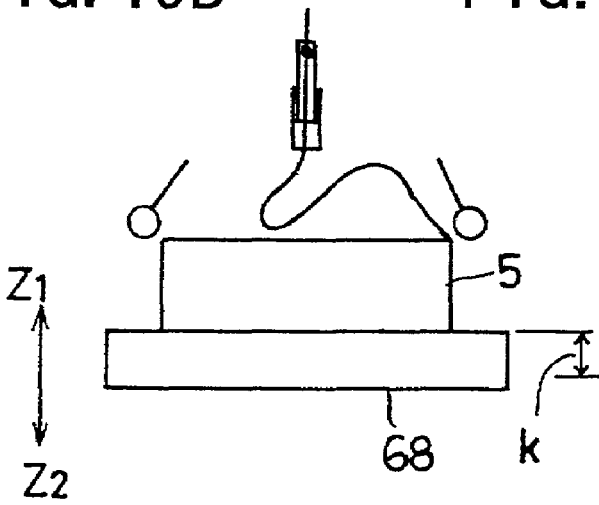

Then, as shown in FIG. 19B, the swing arm 91 is moved to its home position P0. The flap 131 is moved to its home position P000 and the flap 141 is moved to its home position P0000.

Figure 19C:
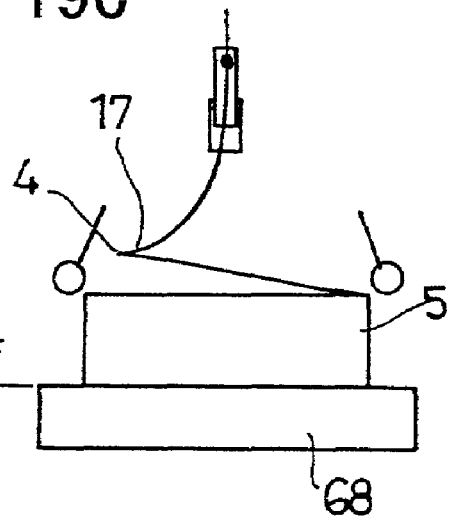
Figure 19D:
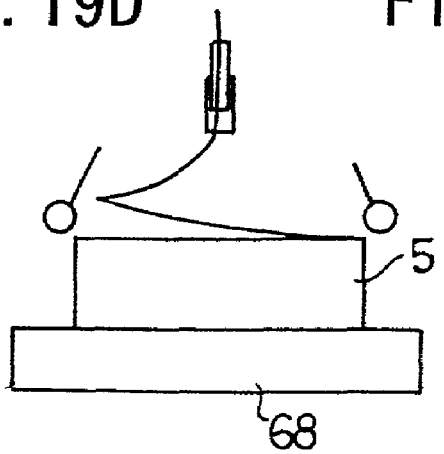

Then, as shown in FIG. 4, the stacker table elevating mechanism 160 is activated by the motor 161. As shown in FIG. 19C, the stacker table 68 is descended for a predetermined distance k and then the stacker table 68 is ascended to an original position as shown in FIG. 19D.

When the stacker table 68 is descended, the continuous medium 1 moves downwards and the bent part is stretched out and the portion of the continuous medium 1 bent by its own stiffness is straightened. The continuous medium 1 will be folded in a wedge-like manner at the transversal perforations 14 as shown by reference 17 and therefore the bending is restored. During an ascending procedure of the stacker table 68, the continuous medium 1 will not be bent.

Figure 19E:
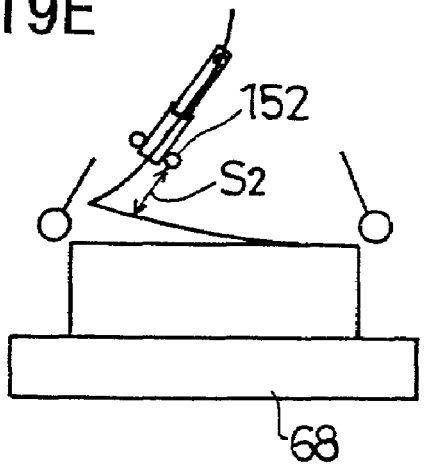

Then, as shown in FIG. 19E, the swing arm 91 returns to a previously stopped position and the distance measuring sensor 152 measures the distance S2 to the continuous medium 1. If the control circuit 170 determines that there is no bend in the continuous medium 1, the electrophotographic printer 60 restarts the printing operation.

Figure 20:
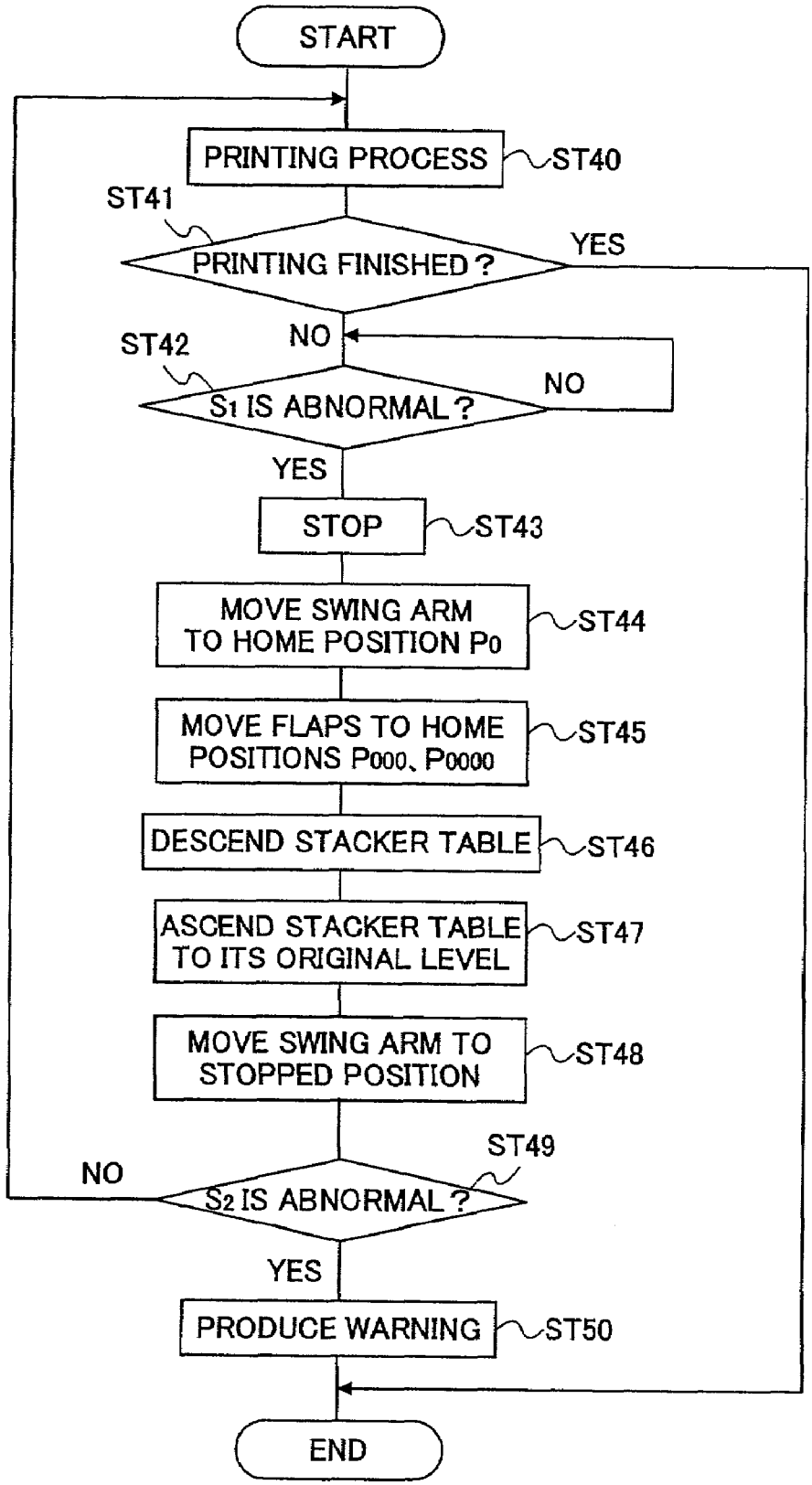
FIG. 20 is a flow chart showing an operation for preventing an occurrence of jamming which is implemented by the control circuit.

The control circuit 170 operates in a manner shown by the flowchart of FIG. 20.

During the printing operation, it is determined whether the data of distance S1 takes an abnormal value or not (ST40, ST41 and ST42).

If the data of distance S1 takes a normal value, an emergency stop signal is output and the printing operation of the electrophotographic printer is stopped (ST43).

Then, the swing arm 91 is moved to home position P0 (ST44) and the flaps 131, 141 are moved to home positions P000, P0000, respectively (ST45).

Then, the stacker table 68 is descended (ST46) and the stacker table 68 is ascended to the original position (ST47).

Then, the swing arm 91 is returned to the previously stopped position (ST48).

Then, it is determined whether distance S2 takes an abnormal value or not (ST49). If it takes a normal value, the printing operation is restarted (ST40). If it takes an abnormal value, a warning is produced (ST50).

It is to be noted that the above-described mechanism for preventing an occurrence of jamming may also be applied for a case where the swing arm does not extend or retract, and has a similar effect.

Also, the above-described continuous medium folding device 80 may find an application at a sheet-processing company for folding continuous medium used as a printing sheet with perforations.

In the following, a further embodiment of the present invention will be described.

The further embodiment of the present invention will be described in detail for its individual mechanism.

Figure 21:
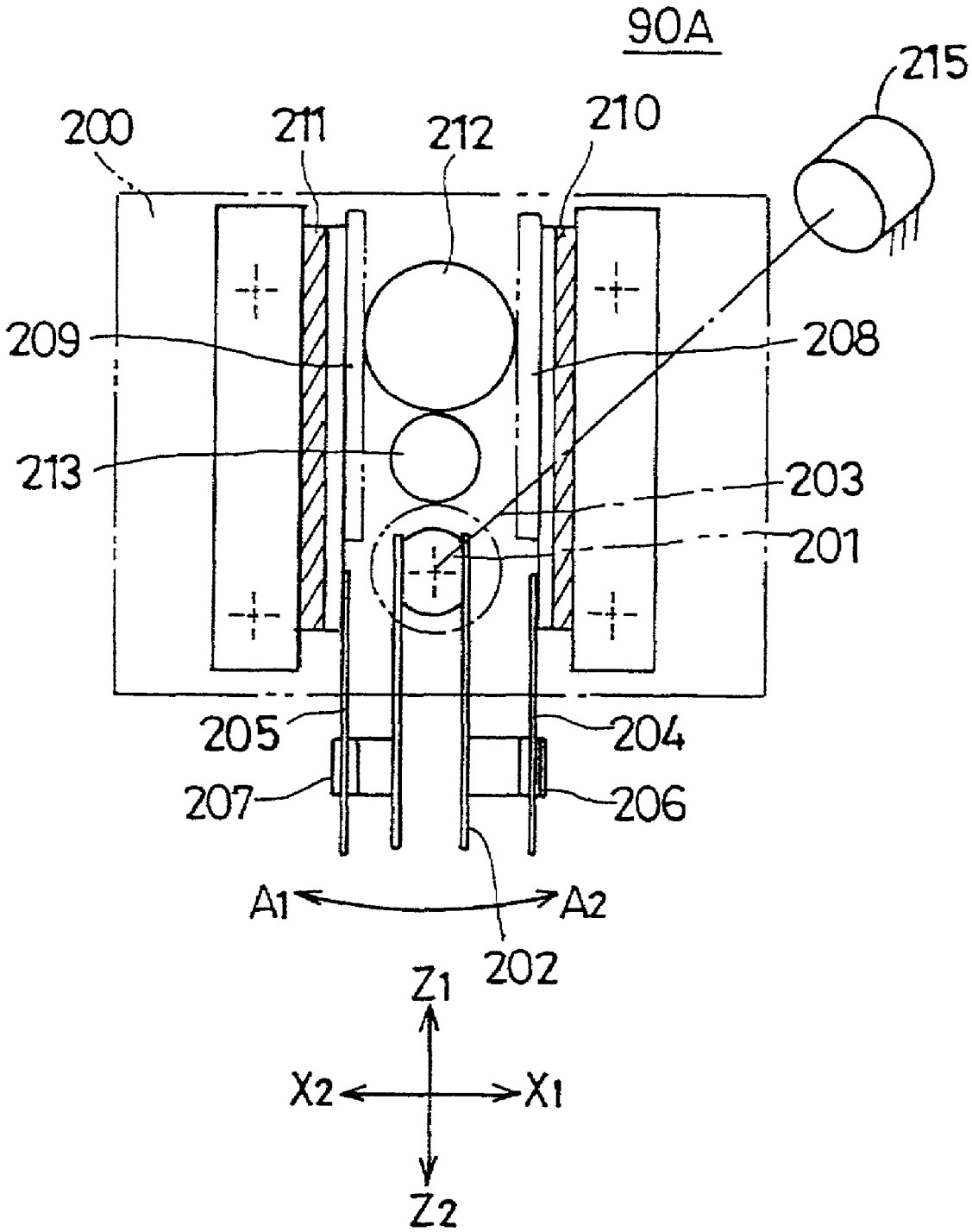
FIG. 21 is a diagram showing a first variant of the continuous medium swinging mechanism.

FIG. 21 is a diagram showing a first variant of the continuous medium swaying mechanism 90A. The continuous medium swaying mechanism 90A includes a main body 200 fixed to a stacker part of an electrophotographic printer and also includes a shaft 201 which pivots in a reciprocating manner. An arm main body 202 and a gear 203 are fixed on the shaft 201. Sub-arms 204 and 205 are made of a flexible material such as a mylar sheet. The sub-arms 204 and 205 are fitted to guiding parts 206 and 207 provided outside the arm main body 202 and are fixed at ends of racks 208 and 209. The racks 208 and 209 are supported by guiding parts 210 and 21 on the main body 200 and also engages a pinion gear 212 on the main body 200. An intermediate gear 213 is provided between the gear 203 and the pinion gear 212.

Figure 22B:
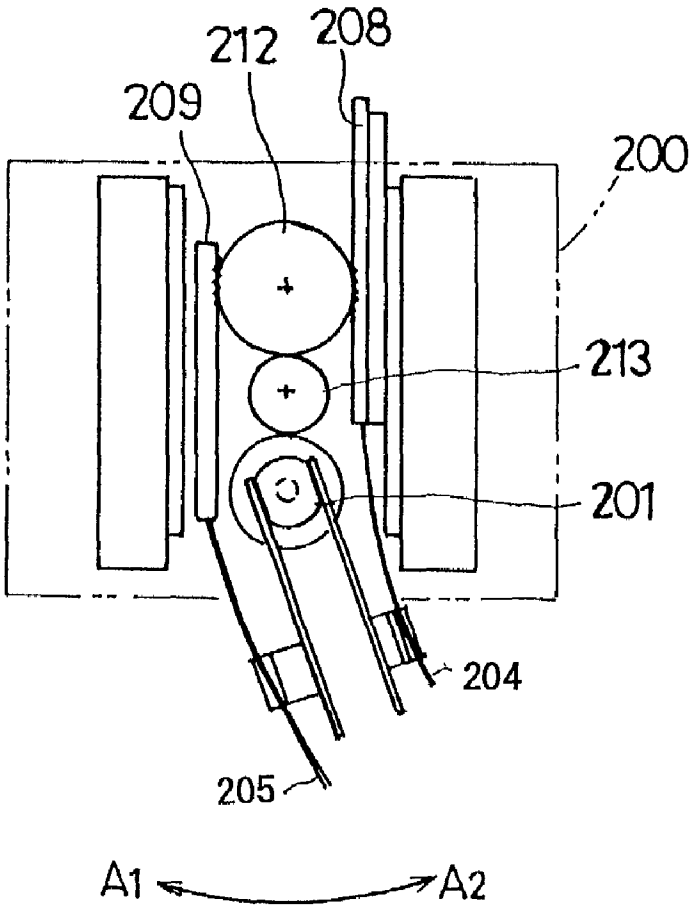
FIGS. 22A and 22B are diagram showing an operation of the mechanism shown in FIG. 21.
Figure 22A:
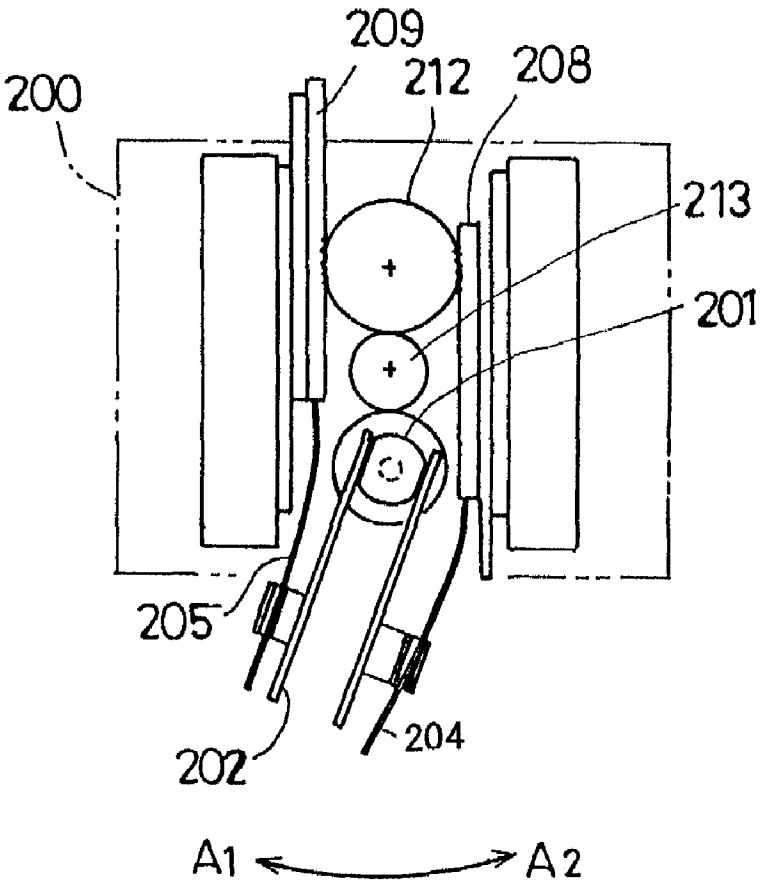

The pulse motor 215 drives the shaft 201 and the arm main body 202 swings in the A1-A2 direction. The rotation of the gear 203 is transferred to the pinion gear 212 via the intermediate gear 213 and the racks 208, 209 are driven in a mutually opposite directions. As shown in FIG. 22A, when the arm main body 202 swings in the A1-direction, the sub-arm 204 on the X1 side protrudes and supports the continuous medium. As shown in FIG. 22B, when the arm main body 202 swings in the A2-direction, the sub-arm 205 on the X2 side protrudes and supports the continuous medium.

The continuous medium swaying mechanism 90A does not have a dedicated motor for moving the sub-arms 204 and 205, but suffices with a single pulse motor. Since there is no motor for moving the sub-arms 204 and 205, an amount of extension of the sub-arm 204 and 205 cannot be controlled. However, there is no inconvenience since the sub-arms 204, 205 are made of a mylar sheet and will deform accordingly if the extended size is too large.

Figure 23:
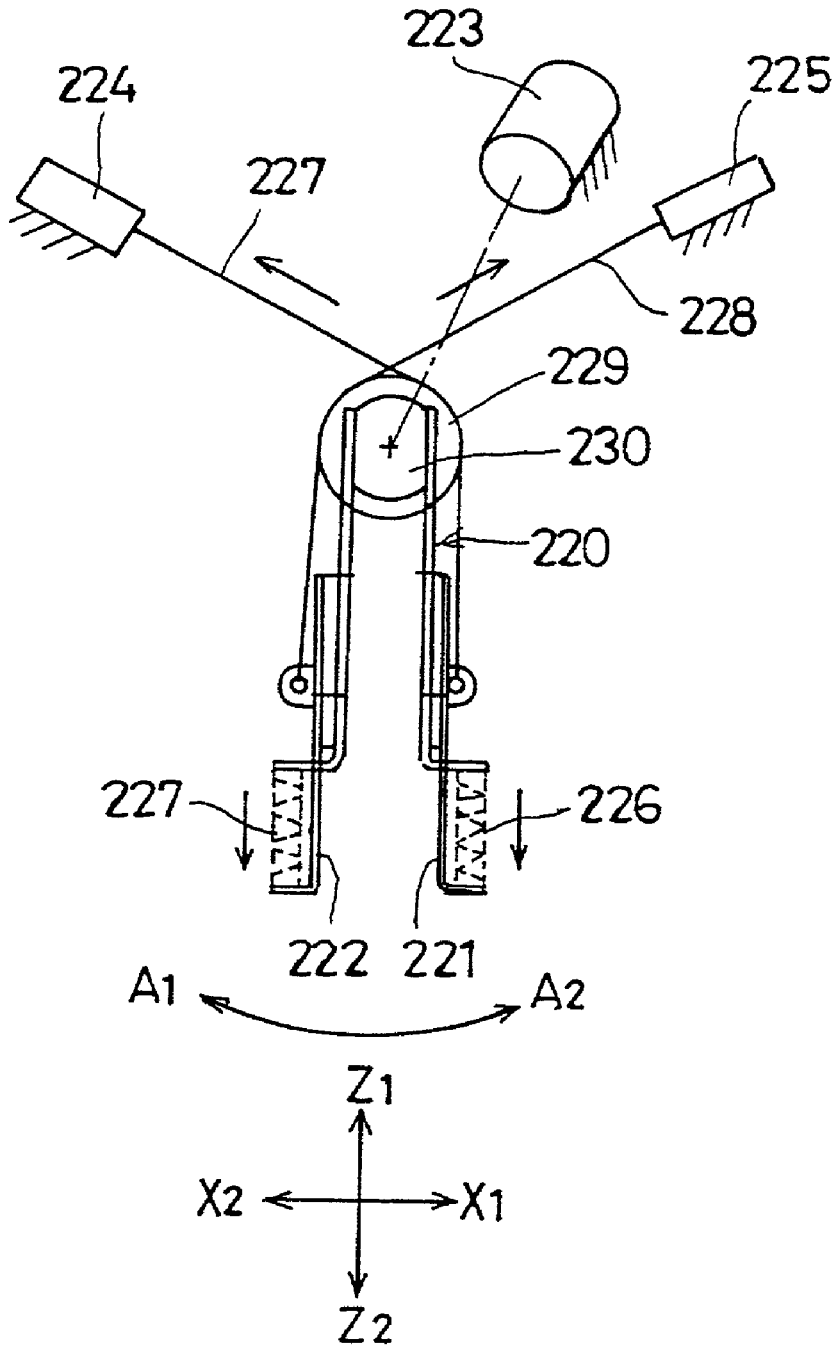
FIG. 23 is a diagram showing a second variant of the continuous medium swinging mechanism.

FIG. 23 is a diagram showing a second variant of the continuous medium swaying mechanism 90B. The continuous medium swaying mechanism 90B includes an arm main body 220, sub-arms 221, 222, a pulse motor 223 and two linearly driven actuators 224, 225. The sub-arms 221, 222 are slidably supported in the Z1-Z2 direction on the outer side of the arm main body 220 and is biased in a direction extending outwardly from the arm main body 220 (Z2-direction) by compression coil springs 226, 227. A wire 227 is provided between the actuator 224 and the sub-arm 221 and a wire 228 is provided between the actuator 225 and the sub-arm 222. Both wires 227, 228 are guided by a pulley 229 and are under tension.

By means of the pulse motor 223, the arm main body 220 swings with the sub-arms 221, 222 about the shaft 230 in the A1-A2 direction.

Figure 24B:
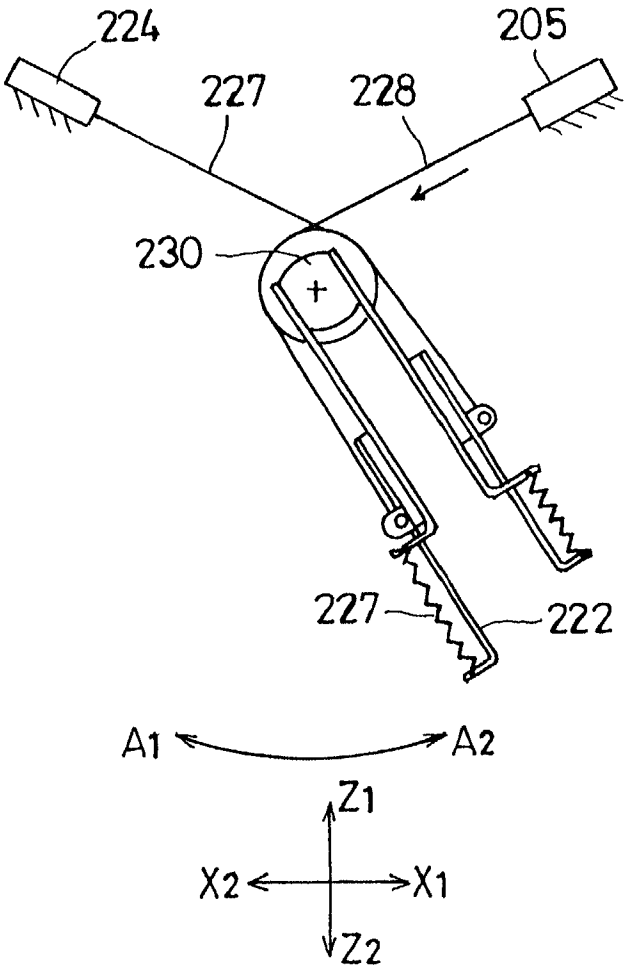
FIGS. 24A and 24B are diagram showing an operation of the mechanism shown in FIG. 23.
Figure 24A:
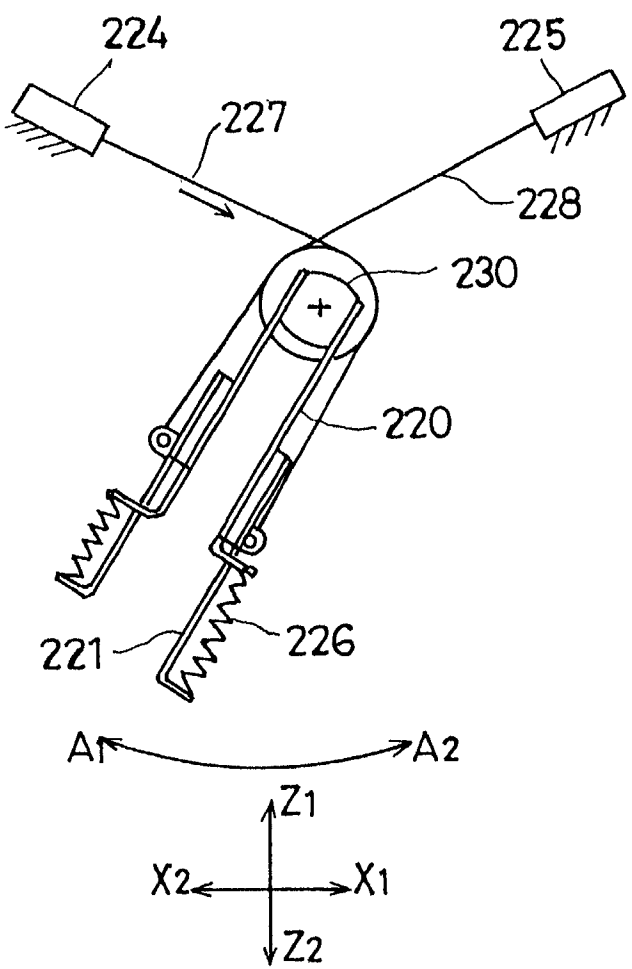

As shown in FIG. 24A, when the arm main body 220 swings in the A1-direction, the actuator 224 operates in a protruding manner and the sub-arm 221 on the X1 side protrudes and extends due to a spring force exerted by the compression coil spring 226. As shown in FIG. 24B, the arm main body 220 is swings in the A2-direction, the actuator 225 in a protruding manner and the sub-arm 222 on the X2 side protrudes and extends due to a spring force exerted by the compression coil spring 227.

Now, a variant of a process of detecting folding error of the continuous medium will be described. According to the present embodiment, as shown in FIG. 25B, a curl of the continuous medium 1 which is indicated by reference 18 is detected at an early stage. When a curl is detected, the electrophotographic printer 60 is stopped.

The distance measuring sensor 152 measures distance S1 between the arm 91 at home position P0 and the top surface 6 of the folded stacked continuous medium 5 on the stacker table 68 and distance S11 between the arm 91 at position P1 which has oscillated through a maximum angle and the top surface of the continuous medium.

The control circuit 170 of FIG. 4 calculates (S11-S10) and compares thus obtained difference with a predetermined value Q. If the difference is greater than the value Q, it is determined as a normal operation and if the difference is less than the value Q, it is determined as an erroneous operation.

Figure 25A:
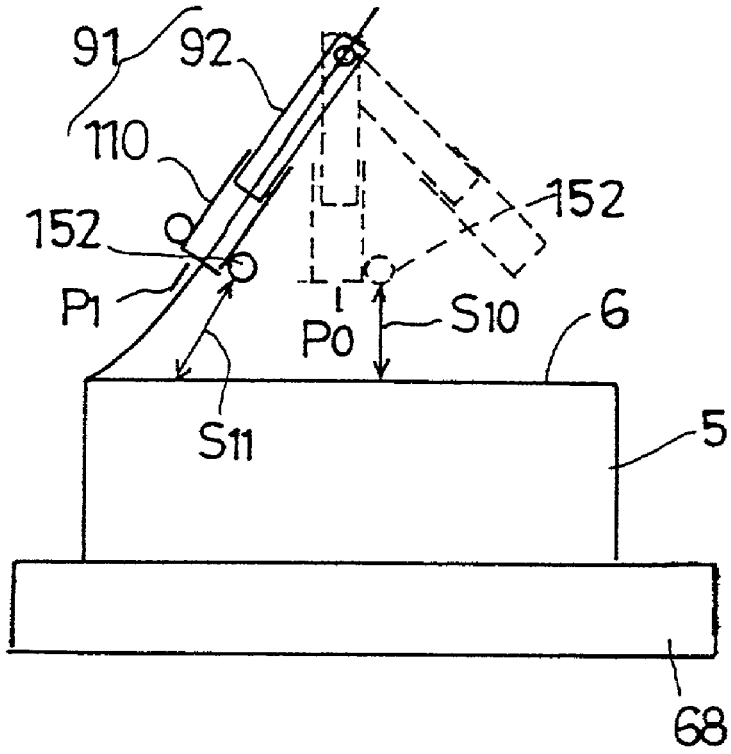
FIGS. 25A and 25B are diagrams showing a variant of an erroneous operation detection during folding of a continuous medium.
Figure 25B:
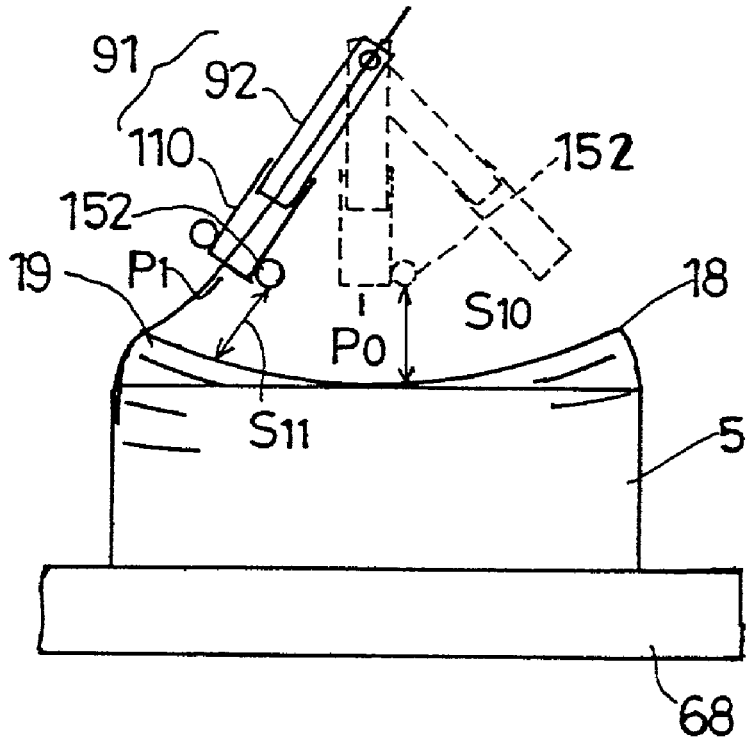

In a state where no curl has occurred, as show in FIG. 25A, (S11-S10) is determined to be greater than the value Q. Therefore, it is determined as a normal operation and printing is continued.

If a curl 18 is produced as shown in FIG. 25B, the distance S11 becomes shorter and (S11-S10) becomes smaller than the value Q. Accordingly, the control circuit 170 determines it as an erroneous operation, produces a stop signal and the electrophotographic printer 60 immediately stops the printing operation.

Figure 26A:
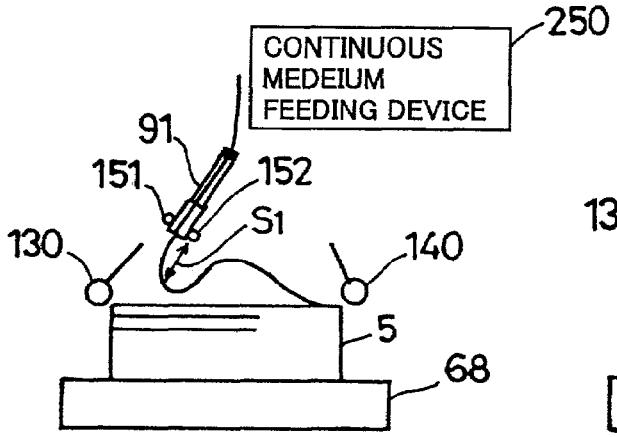
FIGS. 26A to 26E are diagrams for explaining an operation of a variant of a device for preventing an occurrence of jamming.
Figure 26B:
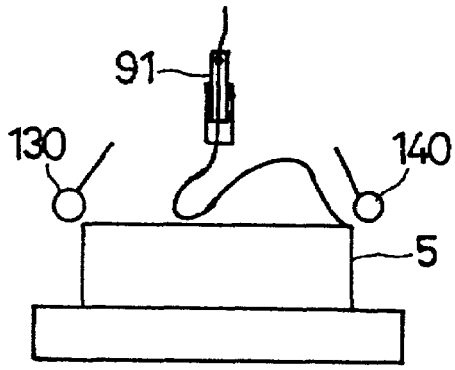
Figure 26C:
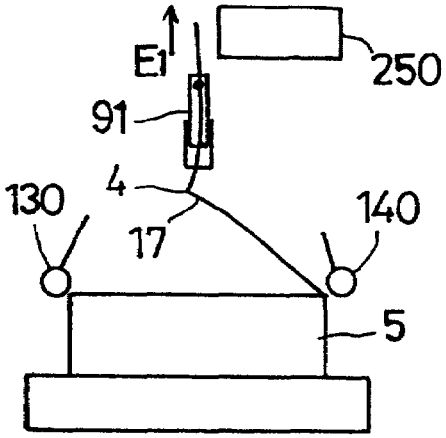
Figure 26D:
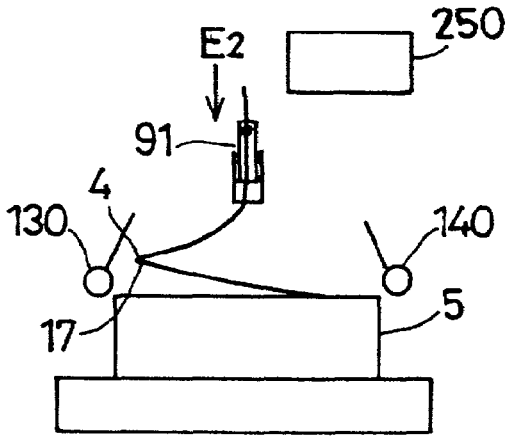

FIGS. 26A to 26E are diagrams showing an operation of preventing an occurrence of jamming in a variant of a jamming occurrence preventing device. The operation differs from the operation illustrated in FIGS. 19A to 19E in that the portions shown in FIGS. 26C and 26D are different.

As shown in FIG. 26A, if there is a bend in the continuous medium 1, the electrophotographic printer 60 stops the printing operation. Then, as shown in FIG. 26B, the swing arm 91 and the flaps 131, 141 are moved to home positions.

Then, the continuous medium feeding device 250 operates such that the continuous medium 1 is moved backwards over a predetermined length in the E1-direction as shown in FIG. 26C. Then, as shown in FIG. 26D, the continuous medium 1 is moved forwards in the E2 direction over a distance corresponding to the distance moved through by the backward movement.

Since the continuous medium 1 is moved backwards, the bent part is stretched out as shown in FIG. 26C. Thus, the portion of the continuous medium 1 bent by its own stiffness is straightened. The continuous medium 1 will be folded in a wedge-like manner at the transversal perforations 14 as shown by reference 17 and therefore the bending is restored. During a step of forwardly moving the continuous medium 1, the continuous medium 1 will not be bent.

Figure 26E:
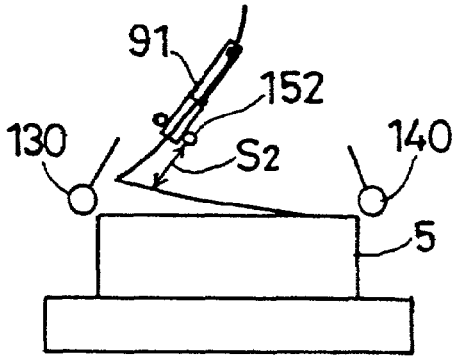

Then, as shown in FIG. 26E, the swing arm 91 is returned to the previously stopped position. In this state, when there is no bend in the continuous medium 1, the electrophotographic printer 60 restarts the printing operation.

Figure 27:
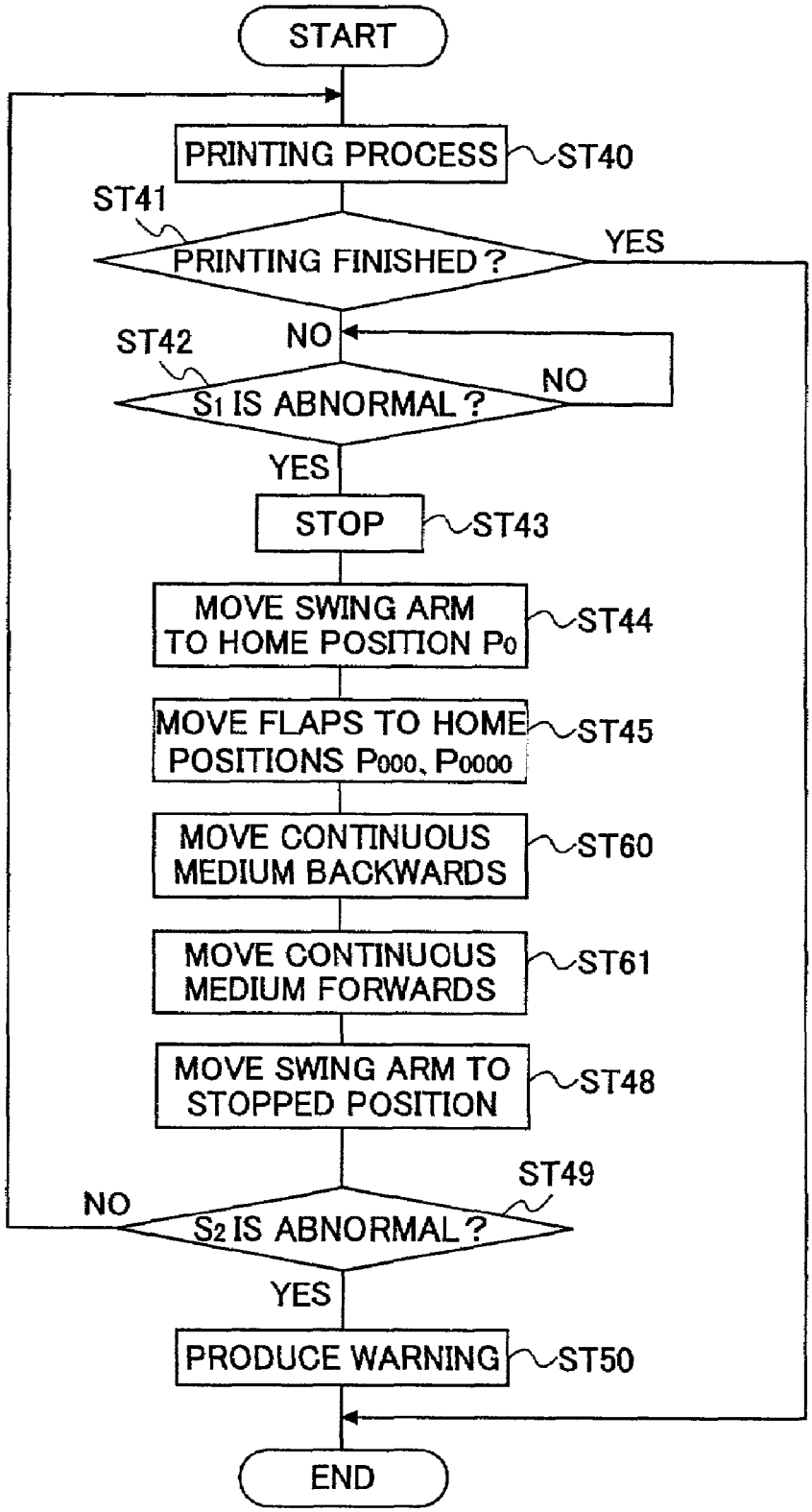
FIG. 27 is a flowchart showing an operation for preventing an occurrence of jamming which is implemented by the control circuit.

The control circuit 170 operates as shown in FIG. 27. The flowchart of FIG. 27 is similar to the flowchart of FIG. 20 except it has ST60 and ST61 instead of ST46 and ST47 in FIG. 20. Therefore, the flowchart of FIG. 27 will not be explained in detail.

In ST60, the continuous medium is moved backwards through a predetermined length. In ST61, the continuous medium is moved forward through a length corresponding to a length moved by a forward movement.

Further, the present invention is not limited to these embodiments, and variations and modifications may be made without departing from the scope of the present invention.

The present application is based on Japanese priority application No. 2001-249119 filed on Aug. 20, 2001, the entire contents of which are hereby incorporated by reference.

What is claimed is:

1. A device for folding a continuous paper having perforations, the device comprising:

a swing arm pivotable about an axis at one end of the swing arm to guide the continuous paper to be accordion-folded along the perforations with equal widths as a result of a swinging operation of the swing arm, and a table that receives the folded continuous paper fed via the swing arm, wherein the swing arm includes a telescopic structure varying the length of the swing arm to at least two different lengths in a swing, wherein the swing arm comprises an arm main body, a sub-arm disposed on a free end of said arm main body, and a telescoping operation motor which extends and retracts said sub-arm from the tip of said arm main body, wherein said swing arm is pivoted about said axis by a swing operation motor disposed in said axis, wherein said sub-arm has a pair of plate members that both project from the tip of said arm main body when the swing arm swings to either side, and wherein said sub-arm maintains a pre-determined distance between a lowest portion of said sub-arm and an upper surface of said continuous paper placed on the table, thereby reducing a size of a part of the continuous paper which is subjected to a wind-pressure.

2. The device as claimed in claim 1, wherein said length of the swing arm is varied such that the tip of the swing arm does not touch the top surface of said folded continuous paper.

3. The device as claimed in claim 1, wherein the table is vertically movable, the device further comprising:

an error detector that detects any fold error of said continuous paper; and a controller that recovers said device from said fold error in such a manner that, upon detection of a fold error, the swinging of the swing arm is stopped, said table is descended through a predetermined distance and then said table is ascended back to its original level.

4. The device as claimed in claim 1, further comprising a creasing mechanism, and wherein said continuous paper is creased with equal widths as a result of the swinging operation of said swing arm and an operation of said creasing mechanism.

5. A device for folding a continuous paper having perforations, the device comprising:

a swing arm pivotable about an axis at one end of the swing arm to guide the continuous paper to be accordion-folded along the perforations and accordion-folded with equal widths as a result of a swinging operation of the swing arm, and a table that receives the folded continuous paper fed via the swing arm, wherein the swing arm includes a telescopic structure varying the length of the swing arm over a range of a swing of the swing arm, wherein the swing arm comprises an arm main body, a sub-arm disposed on a free end of said arm main body, and a telescoping operation motor which extends and retracts said sub-arm from the tip of said arm main body, wherein said length of the swing arm is minimum at the center of said range and gradually increases towards extreme portions of said range, wherein said swing arm is pivoted about said axis by a swing operation motor disposed in said axis, wherein said sub-arm has a pair of plate members that both project from the tip of said arm main body when the swing arm swings to either side, and wherein said sub-arm maintains a pre-determined distance between a lowest portion of said sub-arm and an upper surface of said continuous paper placed on the table, thereby reducing a size of a part of the continuous paper which is subjected to a wind-pressure.

6. A continuous medium printing apparatus provided with a device for folding a continuous paper having perforations, said device comprising:

a swing arm being pivotable about an axis at one end of the swing arm to guide the continuous paper to be accordion-folded along the perforations, said continuous paper being guided by the swing arm and accordion-folded with equal widths as a result of the swinging operation of the swing arm, and a table that receives the folded continuous paper fed via the swing arm, wherein said swing arm includes a telescopic structure such that the length of the swing arm is changed to have at least two different lengths in a swing, wherein the swing arm comprises an arm main body, a sub-arm disposed on a free end of said arm main body, and a telescoping operation motor which extends and retracts said sub-arm from the tip of said arm main body, wherein said swing arm is pivoted about said axis by a swing operation motor disposed in said axis, wherein said sub-arm has a pair of plate members that both project from the tip of said arm main body when the swing arm swings to either side, and wherein said sub-arm maintains a pre-determined distance between a lowest portion of said sub-arm and an upper surface of said continuous paper placed on the table, thereby reducing a size of a part of the continuous paper which is subjected to a wind-pressure.

7. A device for folding a continuous paper having perforations, the device comprising:

a swing arm pivotable about an axis at one end of the swing arm to guide the continuous paper to be accordion-folded along the perforations with equal widths as a result of a swinging operation of said swing arm, and a table that receives the folded continuous paper fed via the swing arm, wherein the swing arm includes an arm main body, a sub-arm disposed on a free end of said arm main body, and a telescoping operation motor which extends and retracts said sub-arm from the tip of said arm main body, wherein the swing arm extends in order to fold the continuous paper along the perforations when the swing arm is swayed toward two edges of the table, wherein said swing arm is pivoted about said axis by a swing operation motor disposed in said axis, wherein said sub-arm has a pair of plate members that both project from the tip of said arm main body when the swing arm swings to either side, and wherein said sub-arm maintains a pre-determined distance between a lowest portion of said sub-arm and an upper surface of said continuous paper placed on the table, thereby reducing a size of a part of the continuous paper which is subjected to a wind-pressure.

8. A device for folding a continuous paper having perforations, the device comprising:

a swing arm pivotable about an axis at one end of the swing arm to guide the continuous paper to be accordion-folded along the perforations with equal widths as a result of a swinging operation of the swing arm, and a table that receives the folded continuous paper fed via the swing arm, wherein the swing arm includes a telescopic structure formed with a plurality of rectangular plates, the telescopic structure varying the length of the swing arm to at least two different lengths in a swing, wherein the swing arm includes an arm main body, a sub-arm disposed on a free end of said arm main body, and a telescoping operation motor which extends and retracts said sub-arm from the tip of said arm main body, wherein said sub-arm has a pair of plate members that both project from the tip of said arm main body when the swing arm swings to either side, and wherein said sub-arm maintains a pre-determined distance between a lowest portion of said sub-arm and an upper surface of said continuous paper placed on the table, thereby reducing a size of a part of the continuous paper which is subjected to a wind-pressure.

* * * * *